US005732761A

United States Patent [19]

Shimizu et al.

[11] Patent Number: 5,732,761

[45] Date of Patent: *Mar. 31, 1998

[54] SHELL MOLD FOR CASTING A CYLINDRICAL PRODUCT, APPARATUS FOR MOLDING THE SHELL MOLD, AND CASTING METHOD USING THE SHELL MOLD

[75] Inventors: Akio Shimizu, Yokkaichi; Taiti Yoshikawa, Kameyama; Masaru Usui, Suzuka; Takehiro Nagaya, Suzuka; Yoshio Kashiwagi, Suzuka; Toshihiro Nishiwaki, Mie-ken, all of Japan

[73] Assignee: Honda Giken Kogyo Kabushiki Kaisha, Tokyo, Japan

[ * ] Notice: The term of this patent shall not extend beyond the expiration date of Pat. No. 5,719,365.

[21] Appl. No.: 626,606

[22] Filed: Apr. 2, 1996

[30] Foreign Application Priority Data

| | | | |
|---|---|---|---|
| Apr. 3, 1995 | [JP] | Japan | 7-077592 |
| Apr. 3, 1995 | [JP] | Japan | 7-077878 |
| Apr. 4, 1995 | [JP] | Japan | 7-078970 |
| Jul. 17, 1995 | [JP] | Japan | 7-179890 |

[51] Int. Cl.[6] ..... B22C 7/00; B22C 13/08; B22D 33/04

[52] U.S. Cl. ..... 164/21; 164/137; 164/165; 164/166; 164/361

[58] Field of Search ..... 164/165, 21, 227, 164/213, 18, 24, 27, 29, 40, 180, 181, 187, 194, 210, 13, 137, 361, 166; 29/888.061, 888.06

[56] References Cited

U.S. PATENT DOCUMENTS

| | | | |
|---|---|---|---|
| 4,203,484 | 5/1980 | Bührer | 164/227 |
| 5,291,862 | 3/1994 | Katoh et al. | 29/888.061 |

FOREIGN PATENT DOCUMENTS

| | | |
|---|---|---|
| 4123892 | 5/1915 | Japan . |
| 4123893 | 5/1915 | Japan . |
| 5177334 | 7/1993 | Japan . |
| 5177335 | 7/1993 | Japan . |
| 5180066 | 7/1993 | Japan . |
| 560639 | 8/1993 | Japan . |
| 5272400 | 10/1993 | Japan . |
| 623514 | 2/1994 | Japan . |
| 623515 | 2/1994 | Japan . |
| 6190504 | 7/1994 | Japan . |
| 663248 | 9/1994 | Japan . |
| 791312 | 4/1995 | Japan . |
| 7251254 | 10/1995 | Japan . |

*Primary Examiner*—Joseph J. Hail, III
*Assistant Examiner*—I. H. Lin
*Attorney, Agent, or Firm*—Sughrue, Mion, Zinn, Macpeak & Seas, PLLC

[57] ABSTRACT

A shell mold includes a plurality of sleeve forming portions. Of the sleeve forming portions, at least an endmost sleeve forming portion located adjacent to a subrunner portion has a modified shape for compensating for deformation of cast sleeves caused by solidification and contraction of molten metal. A shell molding apparatus includes an upper die and a lower die which constitute a die set for molding a shell mold. The lower die is composed of shell molding inserts, each having the shape of a halved cylinder, spiny insert receiving recesses formed in the shell molding inserts, and spiny inserts retractably provided in the spiny insert receiving recesses. In a casting method using a shell mold, many protrusions of a spiny insert are reversely copied to the inner surface of a halved shell mold at the undercut portion of the inner surface, thereby forming many depressions at the undercut portion. The halved shell mold is parted from the lower die. A plurality of bore forming cores are disposed in the halved shell mold. The halved shell mold and another halved shell mold are engaged with each other, thereby forming a shell mold for casting. Casting is performed using the thus formed shell mold.

11 Claims, 29 Drawing Sheets

SHELL MOLD FOR CASTING A CYLINDRICAL PRODUCT, APPARATUS FOR MOLDING THE SHELL MOLD, AND CASTING METHOD USING THE SHELL MOLD

BACKGROUND OF THE INVENTION

1. Field of the Invention

The present invention relates to a shell mold for casting a cylindrical product such as a sleeve for use in a cylinder block, to a shell molding apparatus for molding the shell mold, and to a casting method using the shell mold.

2. Description of the Related Art

In a general practice for manufacturing a cylinder block 80 as shown in FIG. 38, a plurality of cylindrical sleeves 81 are manufactured by casting, and the sleeves 81 are then disposed into the cavity of a die casting die. Subsequently, a molten aluminum alloy is charged into the cavity to cast the cylinder block 80.

For reliable engagement between the sleeves 81 and a block body 82 of aluminum alloy, the sleeves 81 have many protrusions on the surface thereof. According to a conventional practice, such cylindrical sleeves are cast one by one during a casting process using a sand mold formed of greensand or sand which hardens with time.

Due to the one-by-one manufacturing as described above, the conventional method of manufacturing sleeves requires much labor, is inefficient, and further has a drawback that it cannot be used to mass-produce double sleeves or sleeves of a higher multiple.

SUMMARY OF THE INVENTION

The present invention has been achieved in view of the foregoing, and a first object of the present invention is to provide a shell mold which enables the mass production of at least double sleeves and which can suppress the deformation of cast sleeves caused by solidification and contraction of molten metal.

A second object of the present invention is to provide a shell molding apparatus capable of molding with ease and at low cost a shell mold which enables the mass production of at least double sleeves having many protrusions at the undercut portion thereof.

A third object of the present invention is to provide a shell molding apparatus capable of molding with ease a shell mold which can suppress the deformation of cast sleeves caused by solidification and contraction of molten metal.

A fourth object of the present invention is to provide a casting method using a shell mold which can reduce the number of manufacturing steps as compared to a conventional casting method using a desertion core, which is left in a shell mold and ejected together with the shell mold.

In order to attain the first object described above, in a shell mold according to the present invention, a plurality of sleeve forming portions are provided continuously. Of the sleeve forming portions, at least an endmost sleeve forming portion located adjacent to a subrunner portion has a modified shape for compensating the deformation of cast sleeves caused by solidification and contraction of molten metal.

Preferably, the shell mold according to the present invention has the following structure. A plurality of sleeve forming portions are provided continuously. Of the sleeve forming portions, at least a subrunner-side endmost sleeve forming portion has a modified shape as follows. The axis "a'" of a half portion of the endmost sleeve forming portion with respect to its central point Q1 is inclined inwardly from a reference line S' by a predetermined angle θ1, and the axis "b'" of the other half portion is inclined outwardly from the reference line S' by a predetermined angle θ2.

In order to attain the second object described above, a shell molding apparatus according to the present invention includes an upper die and a lower die which constitute a die set for molding a shell mold. The lower die comprises a plurality of shell molding inserts, each having the shape of a halved cylinder, spiny insert receiving recesses which are formed in undercut portions formed by curved surfaces of adjacent shell molding inserts, and spiny inserts retractably provided in the spiny insert receiving recesses, each spiny insert having a surface of the same curvature as the curved surface of the shell molding insert and provided with many protrusions on the surface.

Preferably, the upper die is formed such that the body of the upper die has a plurality of continuously formed recesses corresponding to the plurality of shell molding inserts of the lower die, thereby forming a continuous cavity between the upper and lower dies.

In order to attain the third object described above, in the shell molding apparatus according to the present invention, a cavity in the shape of a shell mold is defined between the recesses formed in the cavity of the upper die and the shell molding inserts of the lower die such that the portion of the space corresponding to the subrunner side end portion of the sleeve forming portion has a modified shape so as to compensate for deformation of a cast sleeve caused by solidification and contraction of molten metal.

Preferably, the shell molding apparatus according to the present invention includes a die set for molding a shell mold which is composed of an upper die and a lower die and has the following structure. The lower die has a plurality of shell molding inserts, each having the shape of a halved cylinder. Of the shell molding inserts, an endmost shell molding insert is modified in shape such that the axis "a" of a half portion of the shell molding insert located on the side of a lateral M/C centerline 01 with respect to the central point Q of the shell molding insert is inclined inwardly from a reference line S by a predetermined angle θ1, the reference line S being in parallel with a longitudinal M/C centerline 02 and that the axis "b" of the other half portion of the shell molding insert located on the side opposite to the lateral M/C centerline 01 with respect to the central point Q is inclined from the reference line S by a predetermined angle θ2. The thus formed shell molding inserts are inserted into the recesses formed in the cavity of the upper die, thereby forming a space in the shape of a sand mold to be molded between the shell molding inserts and the recesses.

Preferably, the shell molding apparatus according to the present invention further includes spiny insert actuating means for projecting and retracting the spiny inserts, upper die moving means for causing the upper die to contact and part from the lower die, and ejecting means for parting a molded shell mold from the lower die.

Preferably, the spiny insert actuating means includes a withdrawal pin connected to the spiny insert, a slide block for actuating the withdrawal pin, and an actuator cylinder for actuating the slide block.

Preferably, the spiny insert actuating means has the following structure. A slide block positioning arm is fixed to the lower die at each of both end portions of the lower die, and a cylinder holding member is fixed to the lower die at the central portion of each of both longer sides of the lower die.

One slide block positioning arm holds one slide block such that the slide block can move toward the spiny inserts. Another slide block positioning arm holds another slide block such that the slide block can move toward the spiny inserts. The slide blocks hold the end portions of a plurality of withdrawal pins connected to the spiny inserts. One actuator cylinder for actuating the one slide block is provided on one cylinder holding member, and another actuator cylinder for actuating the other slide block is provided on another cylinder holding member.

Preferably, many protrusions are formed on the curved surface of the spiny insert by electric spark machining.

In order to attain the fourth object described above, a casting method using a shell mold according to the present invention comprises the steps of: reversely copying many protrusions of a spiny insert to an inner surface of a halved shell mold at the undercut portion of the inner surface by moving a spiny insert provided in a lower die, thereby forming many depressions in the undercut portion; parting the halved shell mold from the lower die; disposing a plurality of bore forming cores in the halved shell mold; engaging the halved shell mold and another halved shell mold each other by mating the halved shell molds with each other at mating surfaces thereof, thereby forming a shell mold for casting; and performing casting using the thus formed shell mold.

DETAILED DESCRIPTION OF THE INVENTION

An embodiment of the present invention will now be described with reference to the drawings.

Figure 1:
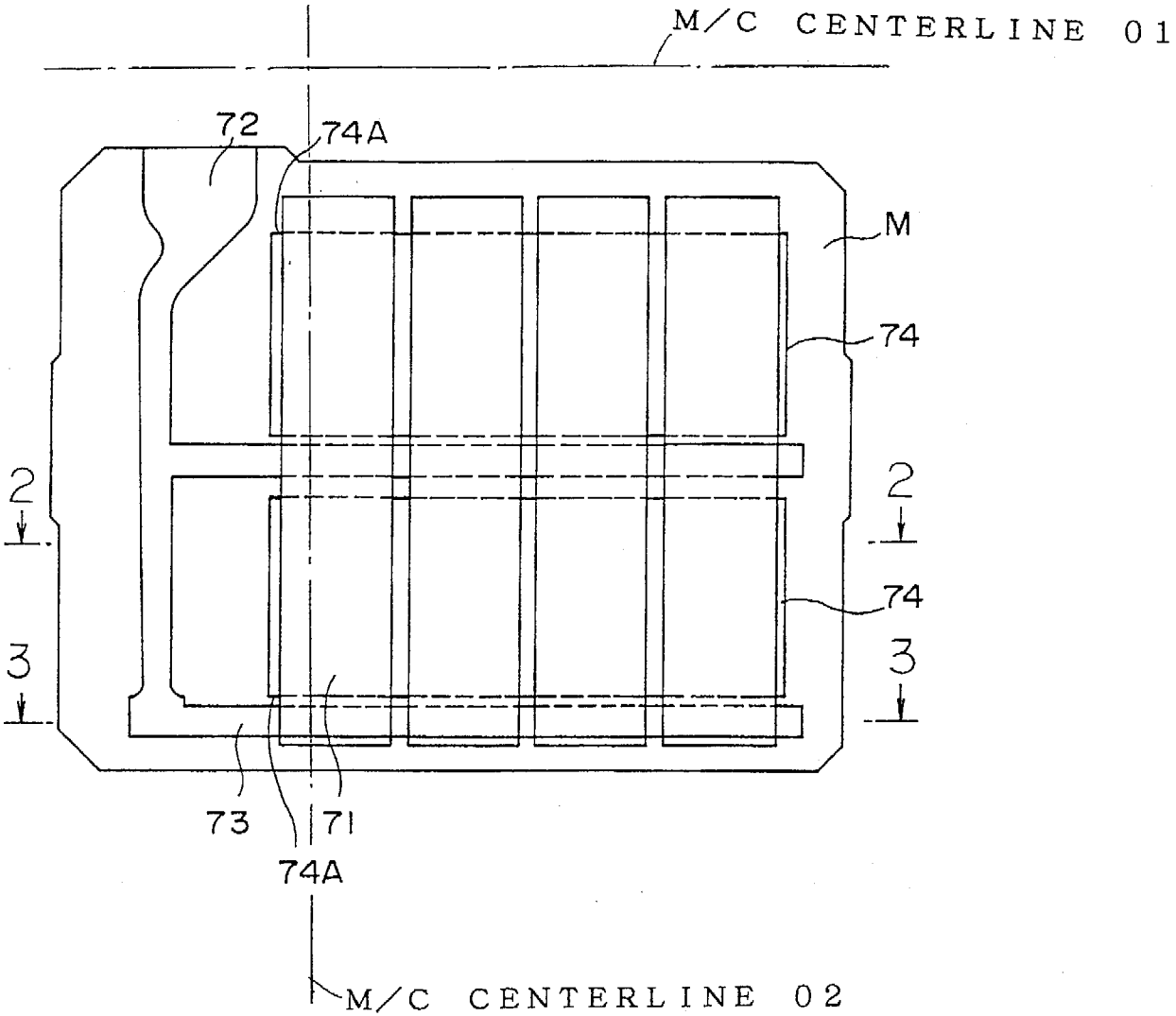
FIG. 1 is a partially cross-sectioned side view showing a shell mold according to an embodiment of the present invention.
Figure 2:
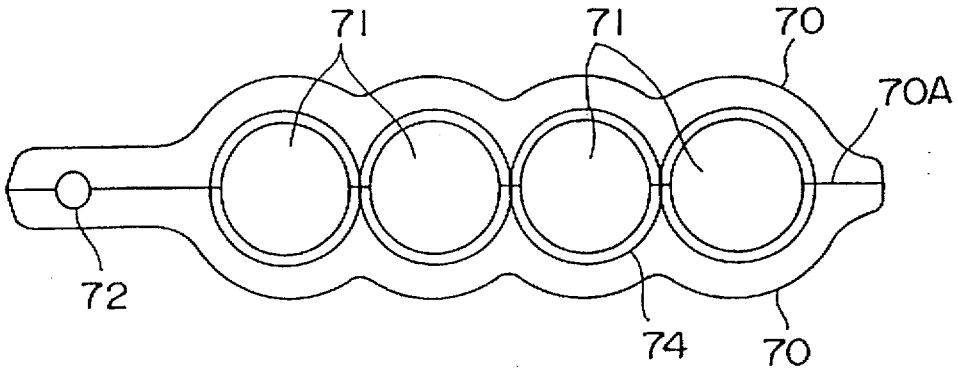
FIG. 2 is a cross-sectional view along line 2—2 of FIG. 1.
Figure 3:
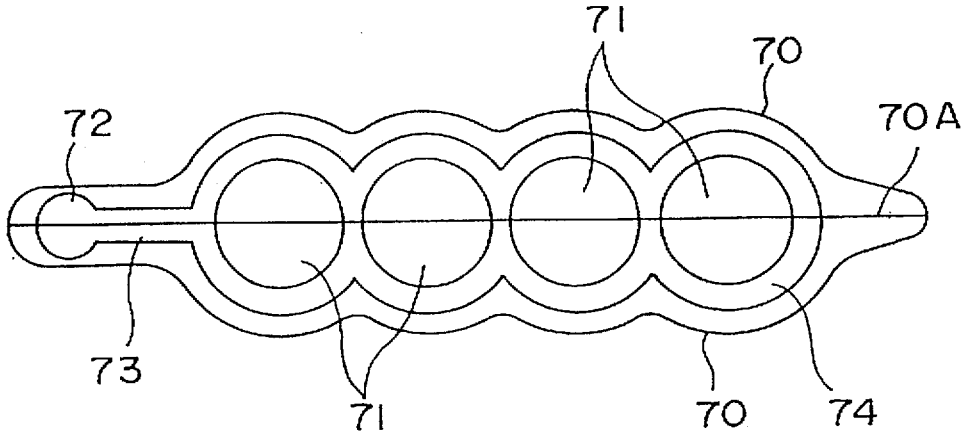
FIG. 3 is a cross-sectional view along line 3—3 of FIG. 1.

FIG. 1 is a partially sectioned plan view of a shell mold. FIG. 2 is a cross-sectional view along line 2—2 of FIG. 1. FIG. 3 is a cross-sectional view along line 3—3 of FIG. 1.

Figure 4:
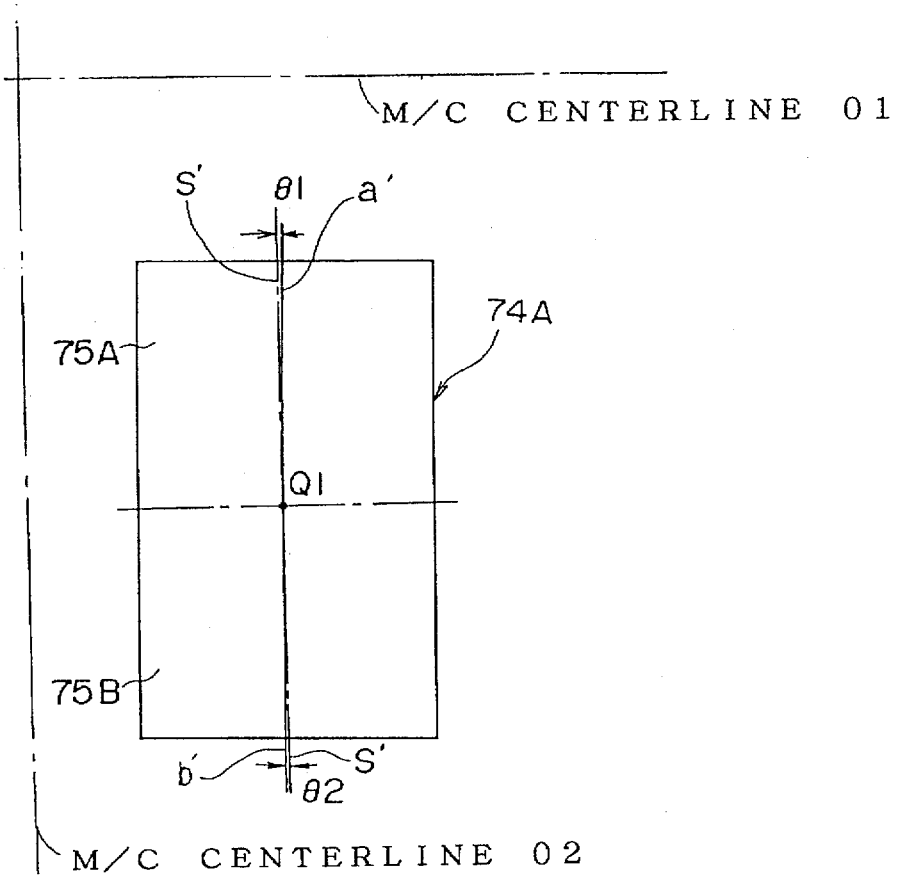
FIG. 4 is a plan view showing the subrunner side sleeve forming portion of the shell mold formed on the MS side.
Figure 5:
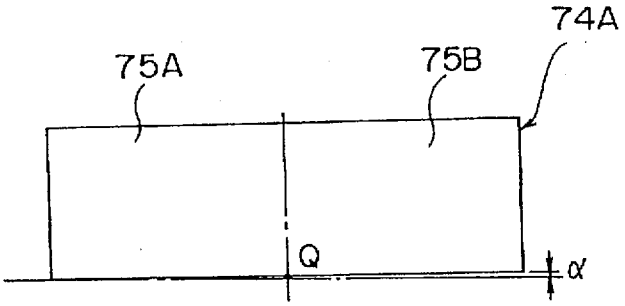
FIG. 5 is a side view of the sleeve forming portion of FIG. 4.

FIG. 4 is a plan view of a sleeve forming portion located on the subrunner side, and FIG. 5 is a side view of the sleeve forming portion.

As shown in FIG. 1, a shell mold M is formed using halved shell molds 70 molded by a shell molding apparatus. That is, the halved shell molds 70 are bonded together using adhesive applied to their mating surfaces 70A, and four bore forming cores 71 are disposed therebetween, thereby completing the shell mold M. The shell mold M has a subrunner portion 73 and quadruple-sleeve forming portions 74.

A molten aluminum alloy is supplied into the shell mold M to cast a quadruple-sleeve W. As seen from FIG. 2 showing the cross-section of the shell mold along line 2—2 and FIG. 3 showing that along line 3—3, the subrunner portion 73 has a thicker wall of molten metal than the quadruple-sleeve forming portion 74. Accordingly, molten metal at the subrunner portion 73 shrinks more than that at the quadruple-sleeve forming portion 74 while the molten metal solidifies. This shrinkage cannot be restricted because the shell mold M is made of sand. As a result, the end portion of a solidified quadruple-sleeve adjacent to the subrunner portion 73 has a greater shrinkage than the other end portion. Exaggeratedly speaking, the quadruple-sleeve deforms into an inverted trapezoidal shape.

The design of the shell mold according to the present invention takes the above-described shrinking phenomenon into consideration. That is, the end portion of the quadruple-sleeve forming portion 74 adjacent to the subrunner 73 is shaped to compensate for the shape of deformation described above, thereby suppressing the deformation of the solidified quadruple-sleeve caused by the shrinkage of molten metal.

That is, a sleeve forming portion 74A of the quadruple-sleeve forming portion 74 adjacent to the subrunner portion 73 has a modified shape as shown in FIGS. 4 and 5. The axis "a'" of an upper half portion 75A located above a center point Q1 in FIG. 4 is inclined inwardly (to the right in FIG. 4) from a reference line S' by a predetermined angle θ1. The axis "b'" of a lower half portion 75B located below the center point Q1 in FIG. 4 is inclined outwardly (to the left in FIG. 4) from the reference line S' by a predetermined angle θ2.

As shown in FIG. 5, the sleeve forming portion 74A is inclined at an angle α such that the end portion of the upper half portion 75A is lower than that of the lower half portion 75B.

As described above, the sleeve forming portion 74A of the quadruple-sleeve forming portion 74 adjacent to the subrunner portion 73 has a modified shape so as to prevent the occurrence of deformation of the solidified quadruple-sleeve caused by the shrinkage of molten metal.

A shell molding apparatus for molding the above-described shell mold will now be described.

Figure 9:
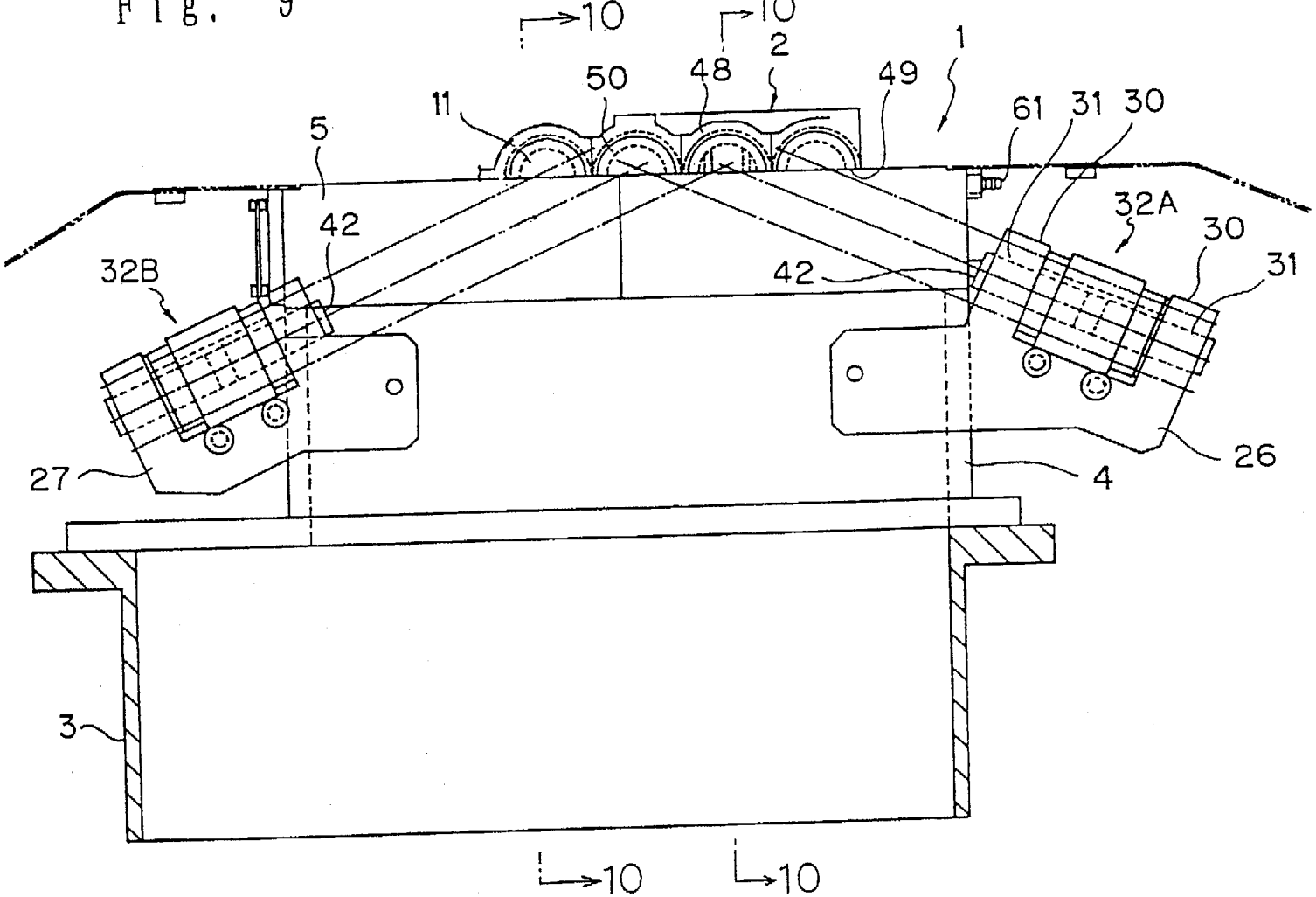
FIG. 9 is a partially cross-sectioned side view showing primarily the lower die of a shell molding apparatus according to the embodiment.
Figure 10:
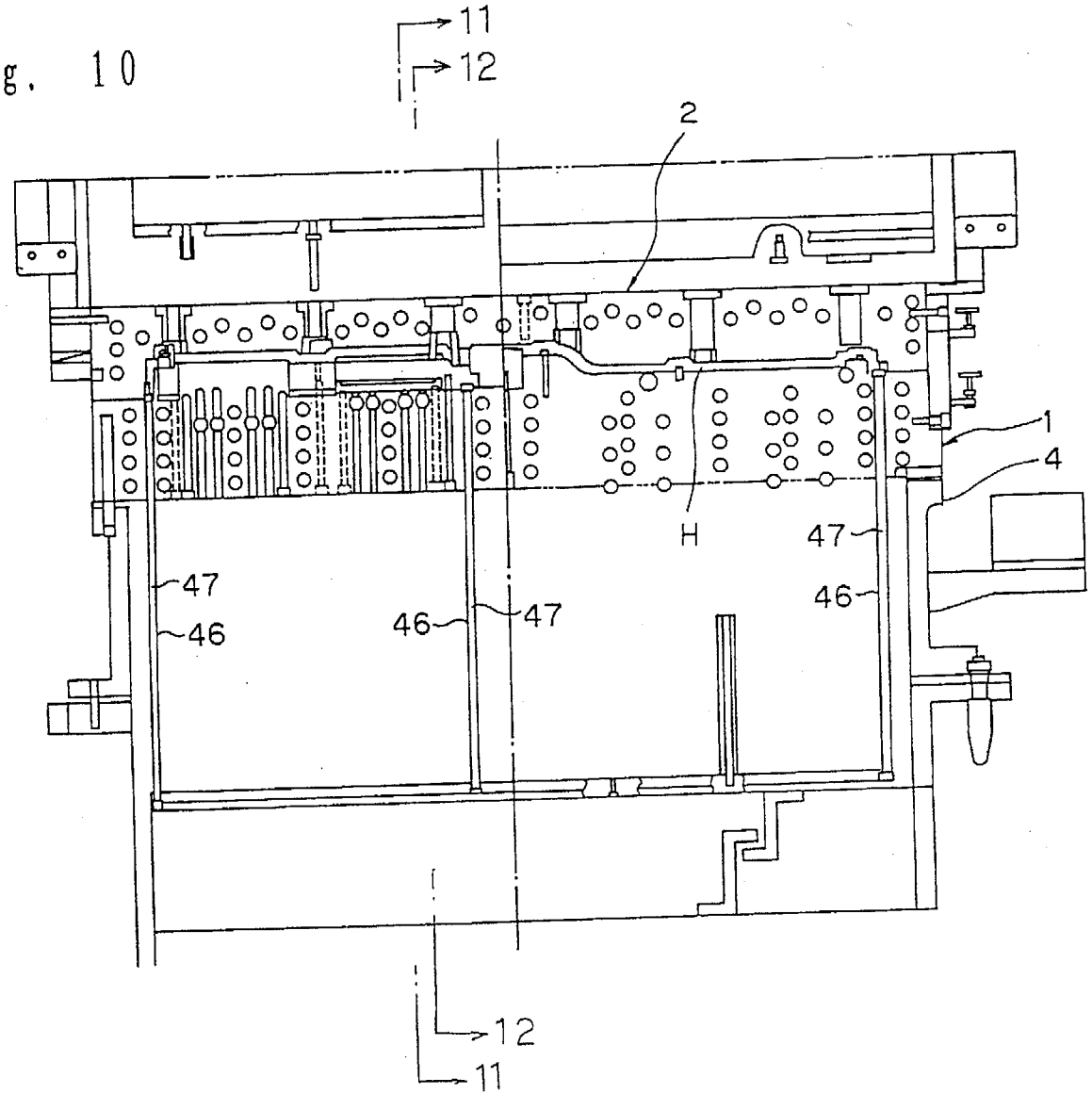
FIG 10 is a cross-sectional view along line 10—10 of FIG. 9.
Figure 11:
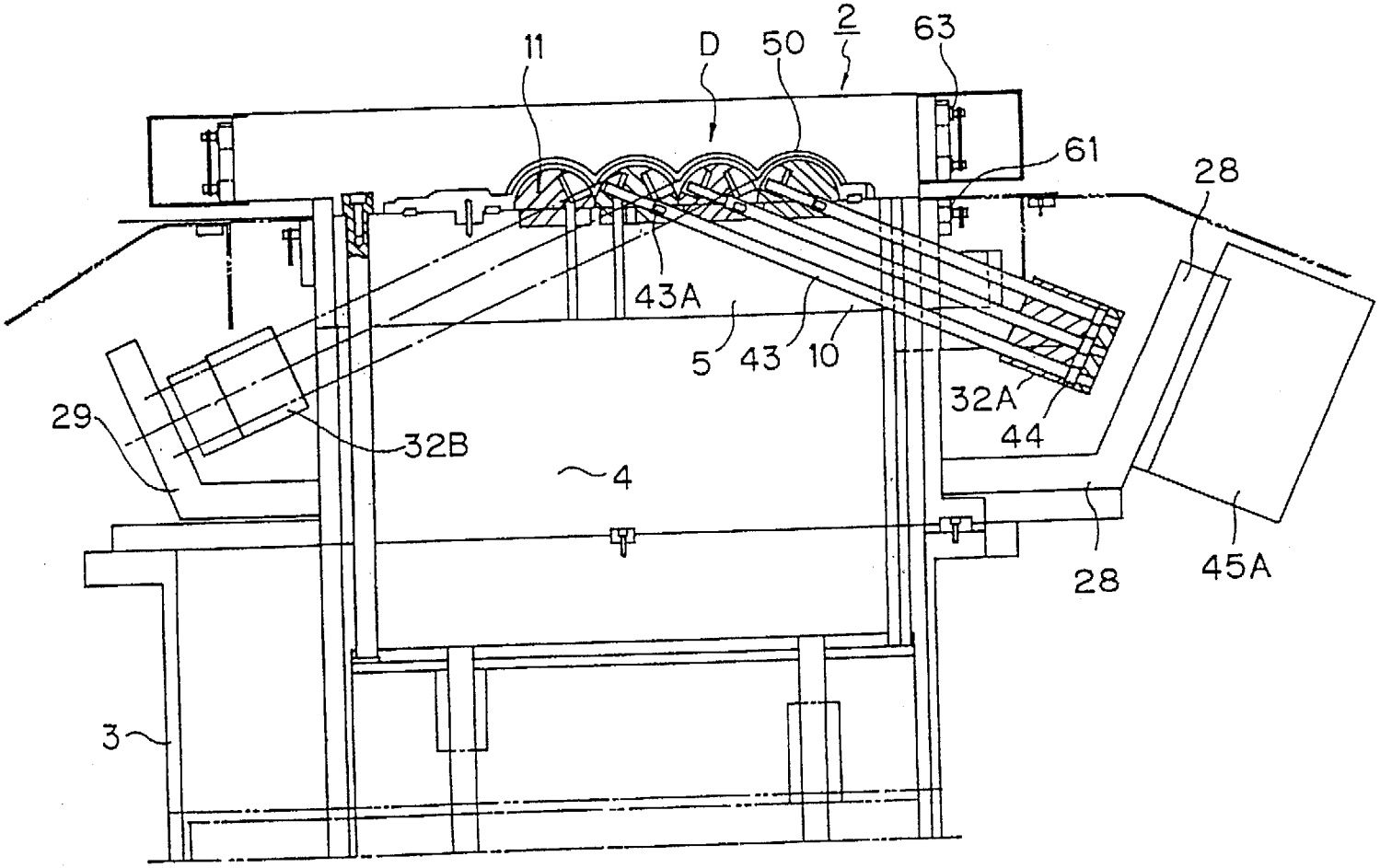
FIG. 11 is a partial cross-sectional view of the shell molding apparatus along line 11—11 of FIG. 10.
Figure 12:
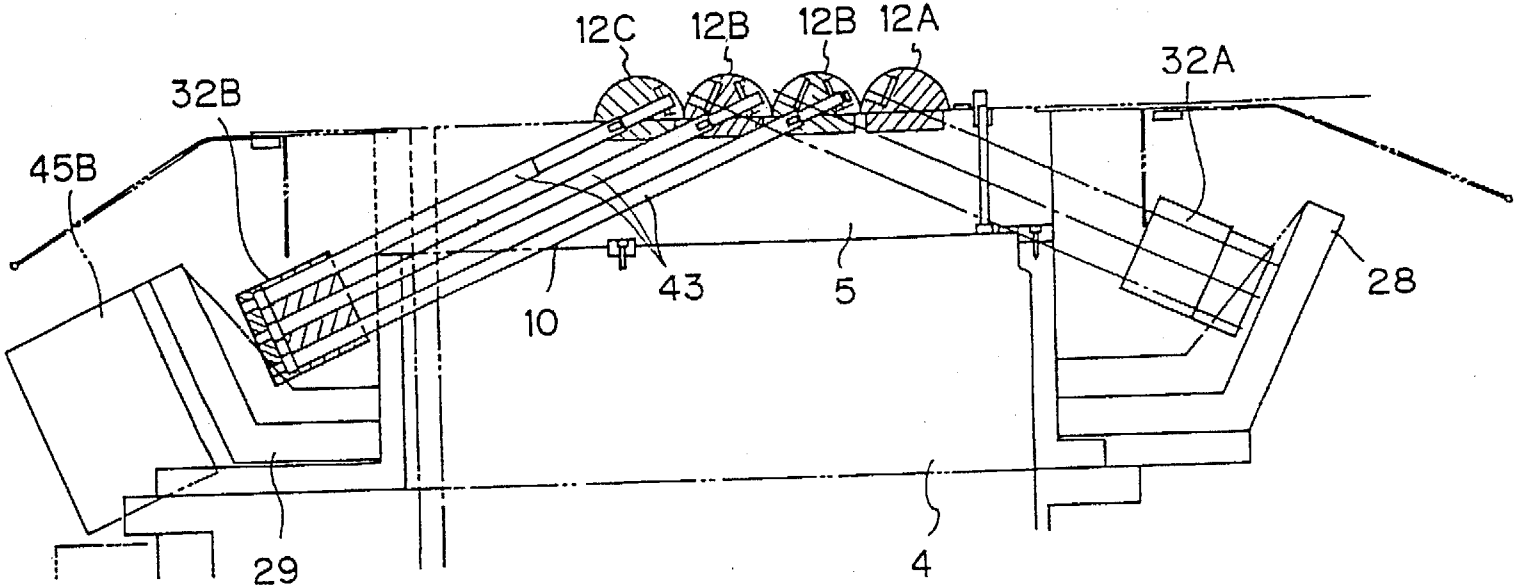
FIG. 12 is a partial cross-sectional view of the shell molding apparatus along line 12—12 of FIG.

FIG. 9 is a partially sectioned side view of the lower mold unit of the shell molding apparatus according to the present invention. FIG. 10 is a cross-section of the shell molding apparatus along line 10—10 of FIG. 9. FIG. 11 is a partial cross-section of the shell molding apparatus along line 11—11 of FIG. 10. FIG. 12 is a partial cross-section of the shell molding apparatus along line 12—12 of FIG. 10.

The shell mold molding apparatus according to the present invention is mainly composed of a lower die 1 and an upper die 2. The lower die 1 has a die base 4 fixedly disposed on an apparatus base 3. A lower die heating block unit 5 is fixed on the die base 4. A shell molding insert structure 11 is mounted on the lower die heating block unit 5. The lower die heating block unit 5 and the shell molding insert structure 11 constitute the lower die unit.

Figure 14:
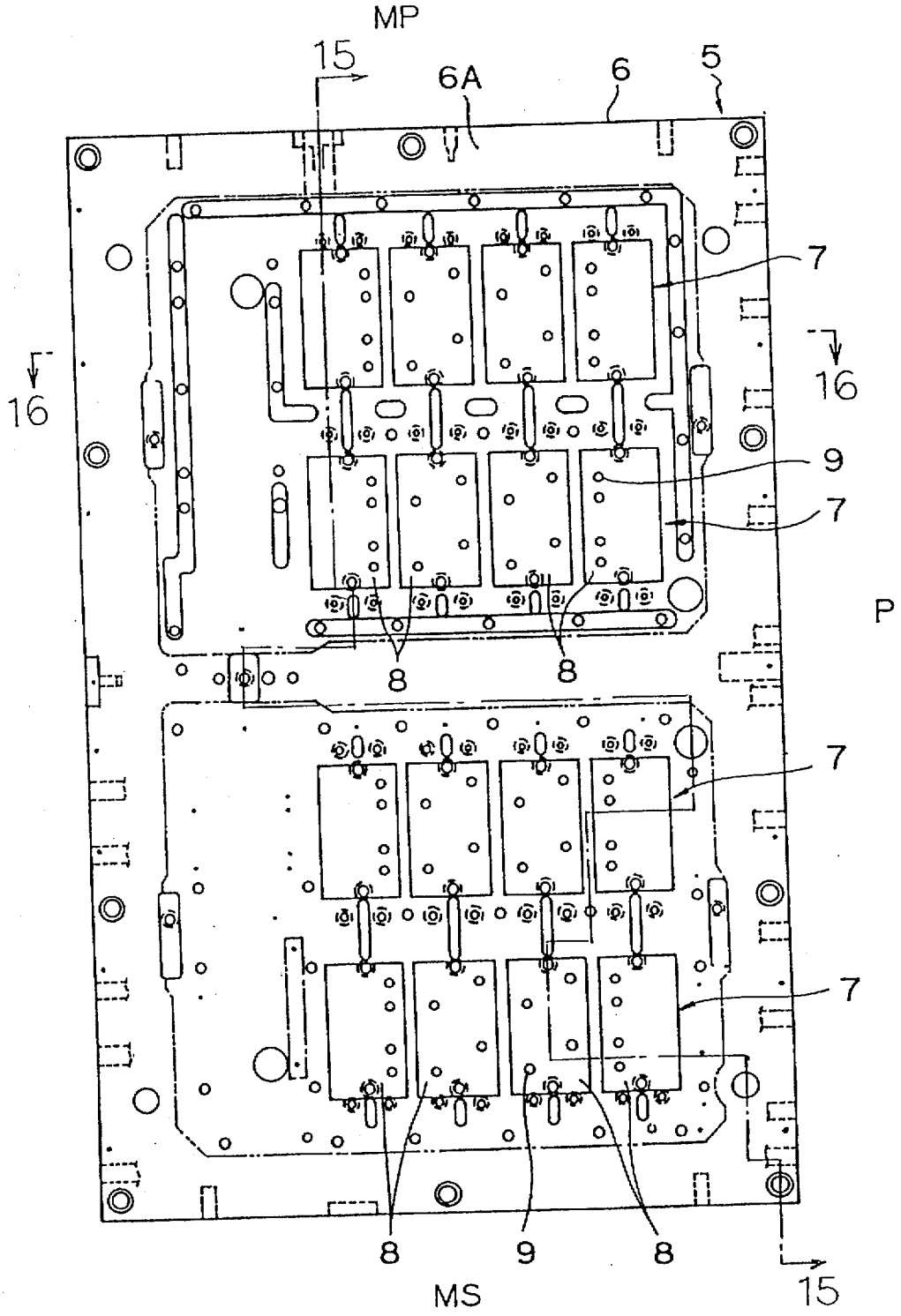
FIG. 14 is a plan view showing a lower die heating block unit.
Figure 15:
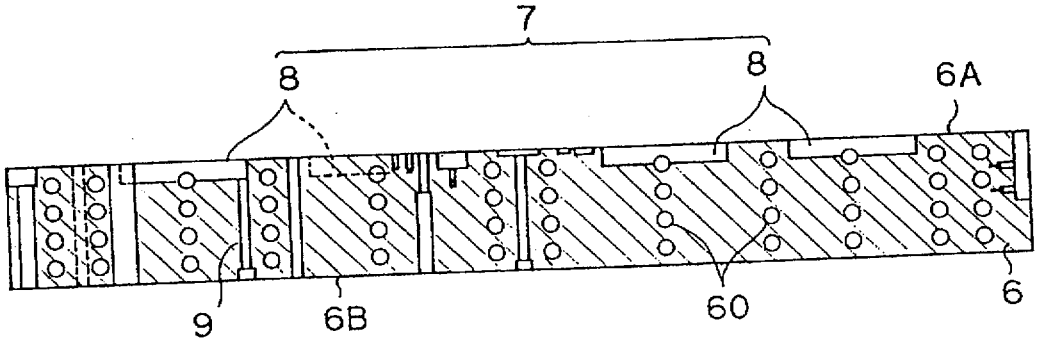
FIG. 15 is a cross-sectional view along line 15—15 of FIG. 14.
Figure 16:
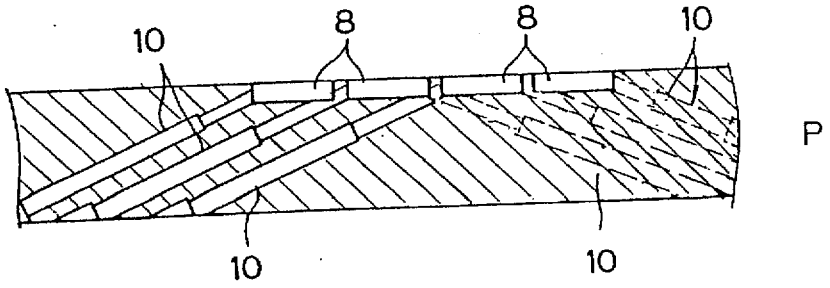
FIG. 16 is a cross-sectional view along line 16—16 of FIG. 14.

As shown in FIGS. 14 to 16, the lower die heating block unit 5 has a heating block 6 having a rectangular shape as viewed from above. Four groups 7 of insert receiving recesses are disposed in rows on the top surface 6A of the heating block 6, two rows on the left half side (MS side) and two rows on the right half side (MP side) as viewed from worker position P. Each group 7 of insert receiving recesses has four insert receiving recesses 8 disposed at a predetermined pitch in the front-rear direction as viewed from the worker position P. A plurality of sand release bores 9 are formed in the bottom portion of the insert receiving recesses 8 such that the sand release bores 9 extend through the heating block 6 to the bottom surface 6B thereof.

For each group 7 of insert receiving recesses, three pin insertion bores 10 are formed in the heating block 6 obliquely upward from the front side (worker position P; hereinafter "front" refers to the side of the worker position P) to front-side three insert receiving recesses and three pin insertion bores 10 are formed in the heating block 6 obliquely upward from the rear side (opposite to the worker position P; hereinafter "rear" refers to the side opposite to the worker position P) to rear-side three insert receiving recesses 8. Many heater insertion bores 60 are formed in right and left end portions of the heating block 6. Heaters 61 are inserted into the heater insertion bores 60 (see FIG. 9).

As shown in FIGS. 17 to 21, the shell molding insert structure 11 has two groups 12 of shell molding inserts in two rows, each group having four shell molding inserts, Each group 12 of shell molding inserts has a front-side shell molding insert 12A, two intermediate shell molding inserts 12B, and a rear-side shell molding insert 120. The front-side shell molding insert 12A has an insert body having a semicircular cross-section. The insert body 13 has a rectangular fitting portion 14 at the bottom portion thereof and a flat mating surface 15 at the rear side thereof. A spiny insert receiving recess 16 having a rectangular shape as viewed from above is formed in the insert body 13 at the rear portion thereof. Rod insertion bore portions 17 are formed in the insert body 13 such that they extend from the front surface of the fitting portion 14 to the bottom surface of the spiny insert receiving recess 16. Sand release bores 18 are formed in the insert body 13 such that they extend from the bottom surface of the spiny insert receiving recess 16 to the bottom surface of the fitting portion 14.

Figure 6A:
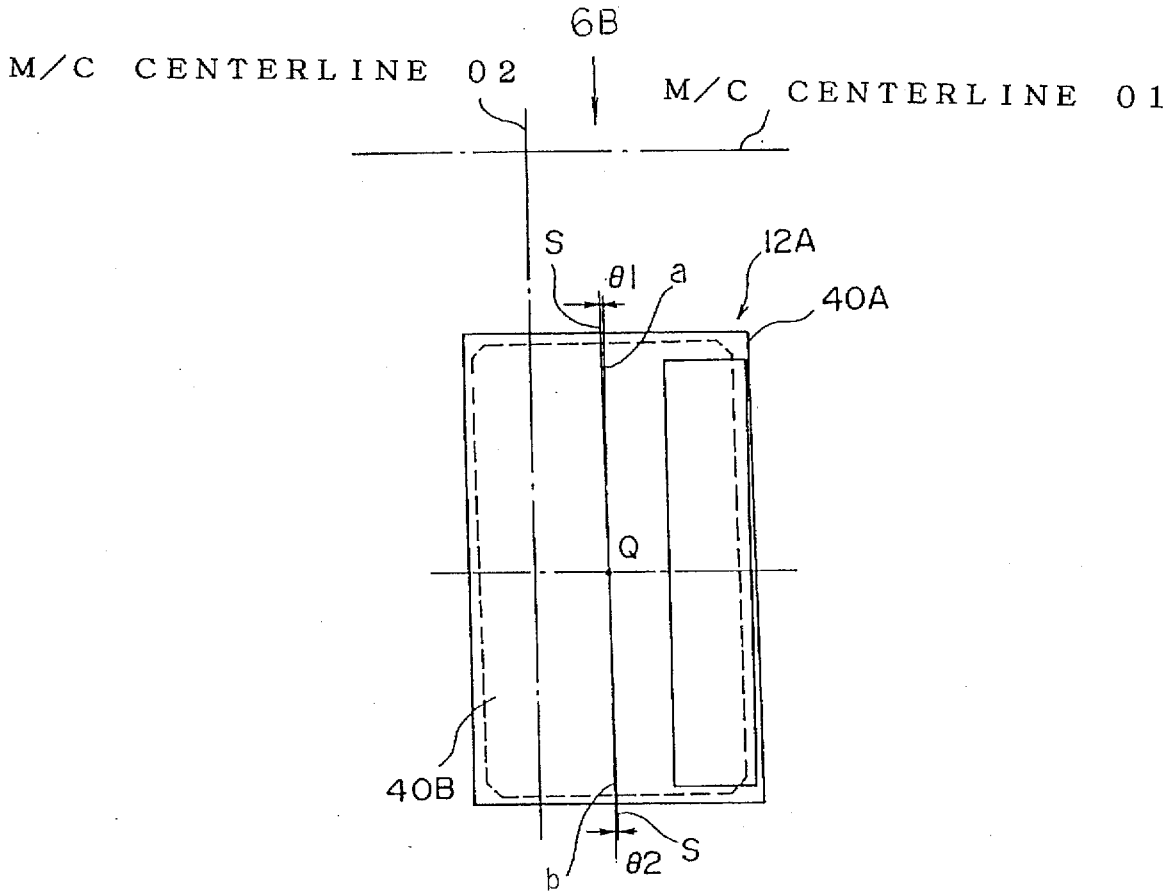
FIG. 6A is a plan view showing a shell molding insert serving as a lower die for the sleeve forming portion of FIG. 4.
Figure 6B:
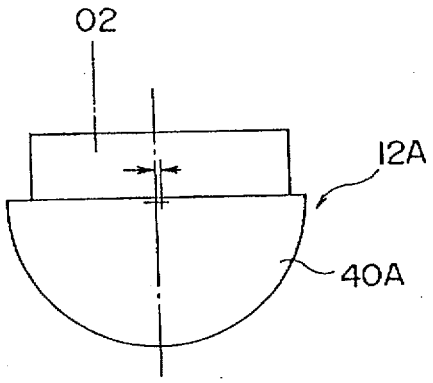
FIG. 6B is a view showing the shell molding insert as viewed in the direction of arrow 6B of FIG. 6A.

The front-side shell molding insert 12A may has a modified shape as follows. The axis "a" of a half portion 40A of the front-side shell molding insert 12A located on the side of the lateral M/C centerline 01 with respect to a center point Q in FIG. 6A is inclined inwardly (to the right in FIG. 6A) from a reference line S by a predetermined angle (31, the reference line S being in parallel with a longitudinal M/C centerline 02. The axis "b" of another half portion 40B of the front-side shell molding insert 12A located opposite to the side of the lateral M/C centerline 01 with respect to a center point Q is inclined outwardly (to the left in FIG. 6A) from the reference line S by a predetermined angle θ2.

Figure 7:
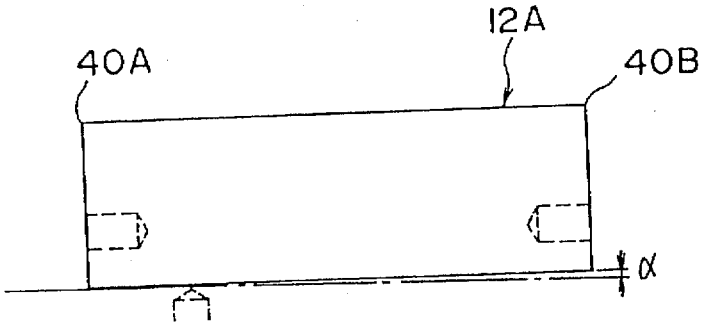
FIG. 7 is a side view showing the shell molding insert of FIG. 6A.

Also, as shown in FIG. 7, the front-side shell molding insert 12A may be inclined at an angle α such that the end portion of the half portion 40A located on the side of the lateral M/C centerline 01 is lower than that of the half portion 40B located on the side opposite to the lateral M/C centerline 01.

Figure 17:
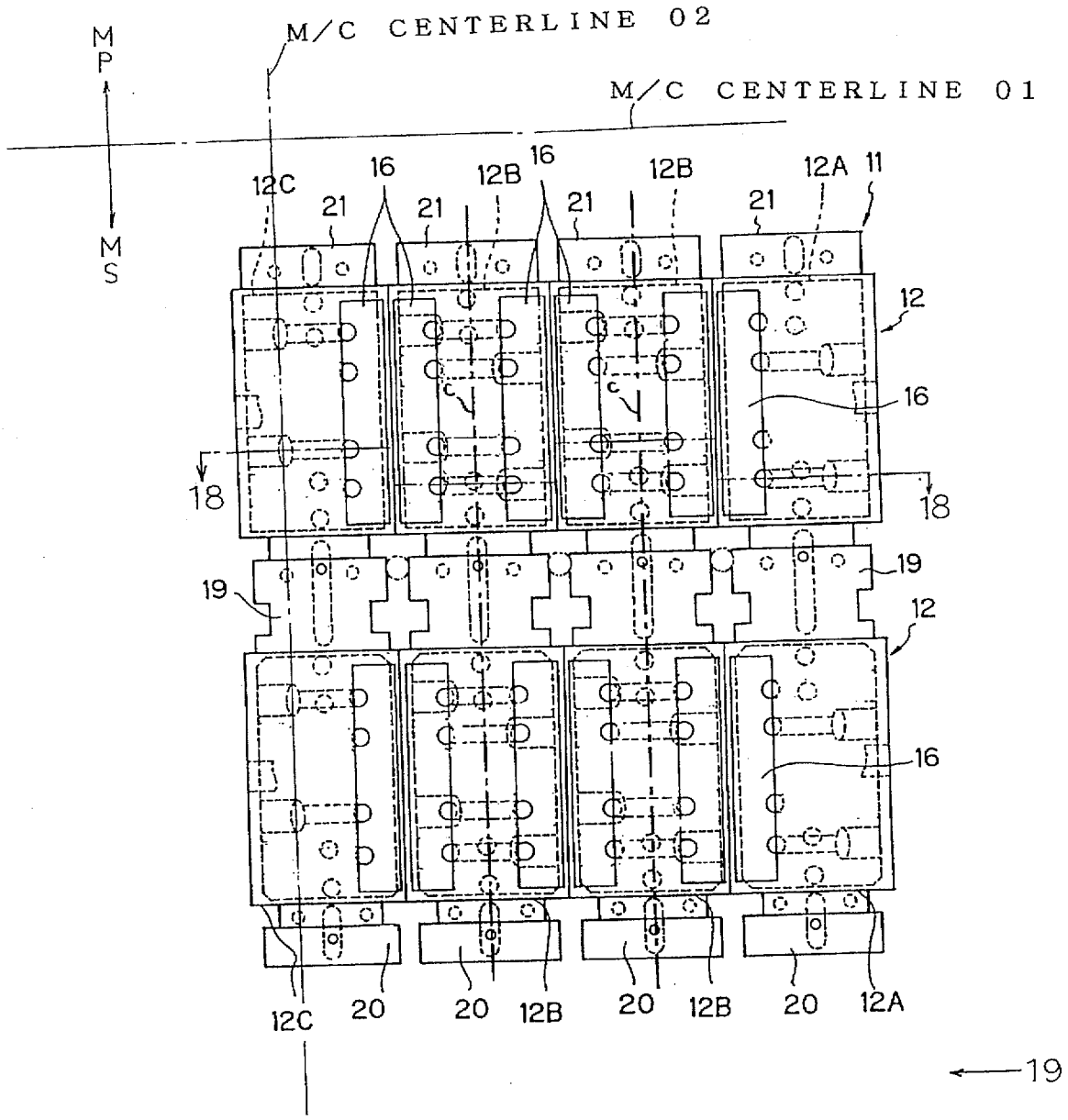
FIG. 17 is a plan view showing a shell molding insert structure.
Figure 18:
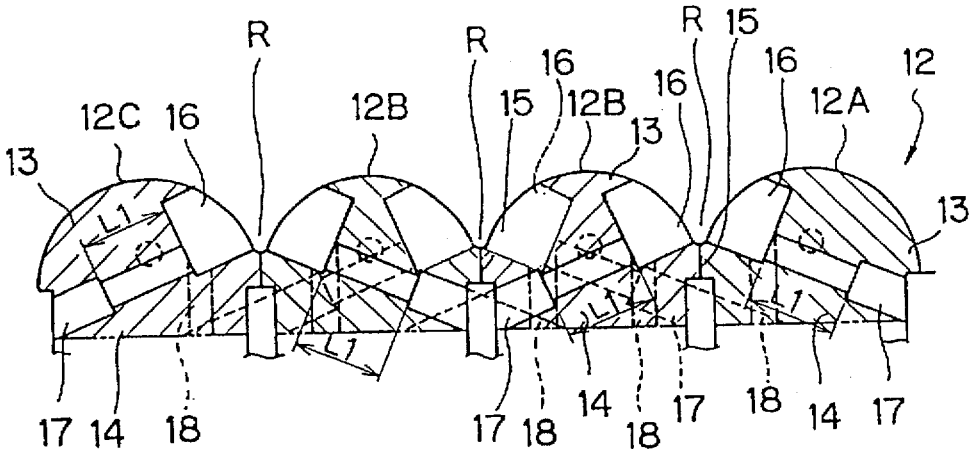
FIG. 18 is a cross-sectional view along line 18—18 of FIG. 17.
Figure 19:
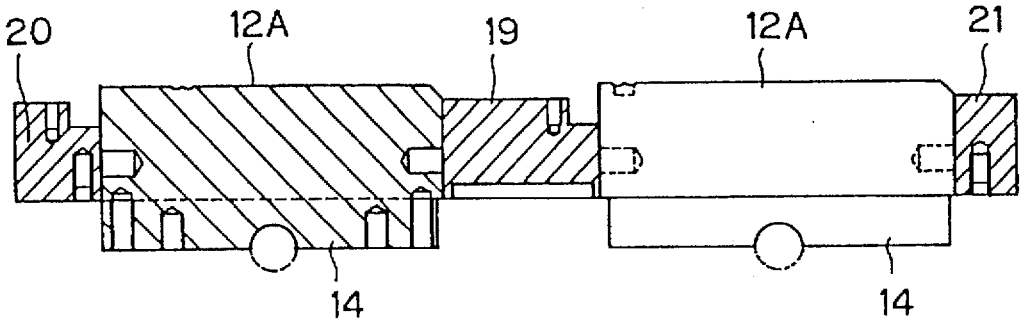
FIG. 19 is a partial cross-sectional view showing the shell molding insert structure as viewed in the direction of arrow 19, of FIG. 17.
Figure 20:
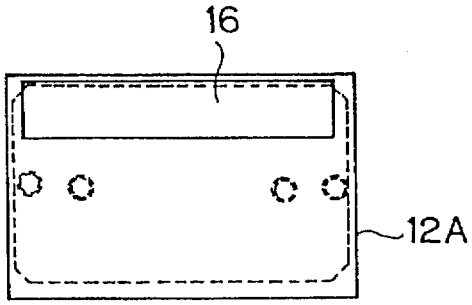
FIG. 20 is a plan view showing one shell molding insert.
Figure 21:
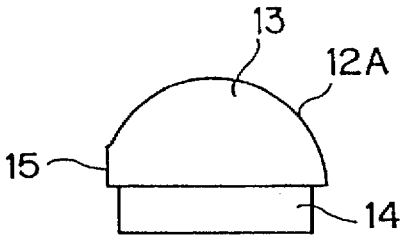
FIG. 21 is a side view of the shell molding insert of FIG. 20.
Figure 22:
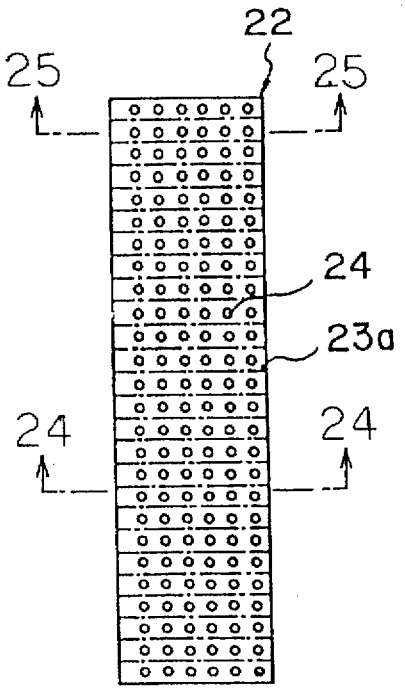
FIG. 22 is a plan view showing a spiny insert.
Figure 23:
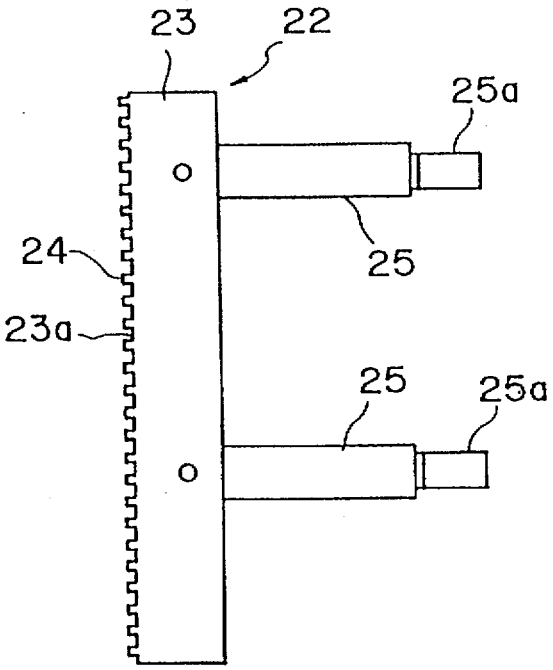
FIG. 23 is a side view of the spiny insert.
Figure 24:
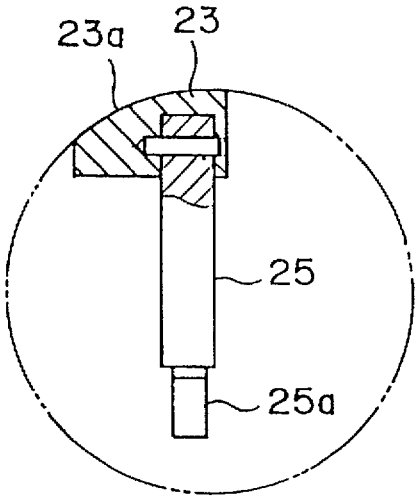
FIG. 24 is a cross-sectional view along line 24—24 of FIG. 22.
Figure 25:
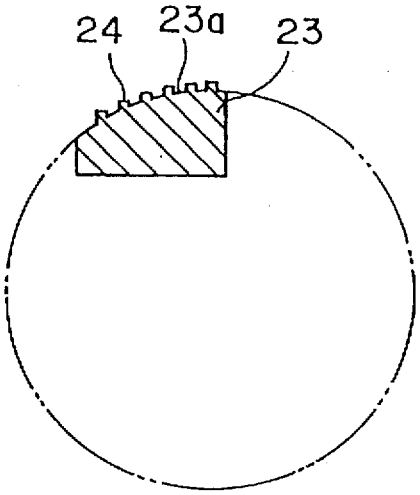
FIG. 25 is a cross-sectional view along line 25—25 of FIG. 22.

Each of the intermediate shell molding inserts 12B has an insert body 13 having a semicircular cross-section. The insert body 13 has a rectangular fitting portion 14 at the bottom portion thereof and a flat mating surface 15 at each of the front and rear sides thereof. A spiny insert receiving recess 16 having a rectangular shape as viewed from above is formed in the insert body 13 at each of the front and rear portions thereof. Rod insertion bore portions 17 are formed in the insert body 13 such that they extend from the front surface of the fitting portion 14 to the bottom surface of the rear-side spiny insert receiving recess 16. Also, rod insertion bore portion 17 are formed in the insert body 13 such that they extend from the rear surface of the fitting portion 14 to the bottom surface of the front-side spiny insert receiving recess 16. Sand release bores 18 are formed in each insert body 13 such that they extend from each spiny insert receiving recess 16 to the bottom surface of the corresponding fitting portion 14. As shown in FIG. 17, the axis c of each intermediate shall molding insert 12B is in parallel with the reference line S, which is in parallel with the longitudinal M/C centerline 02.

The rear-side shell molding insert 12C has an insert body 13 having a semicircular cross-section. The insert body 13 has a rectangular fitting portion 14 at the bottom portion thereof and a flat mating surface 15 at the front side thereof. A spiny insert receiving recess 16 having a rectangular shape as viewed from above is formed in the insert body 13 at the front-portion thereof. Rods insertion bore portion 17 are formed in the insert body 13 such that they extend from the rear surface of the fitting portion 14 to the bottom surface of the spiny insert receiving recess 16. Sand release bores 18 are formed in the insert body 13 such that they extend from the spiny insert receiving recess 16 to the bottom surface of the fitting portion 14.

Figure 8:
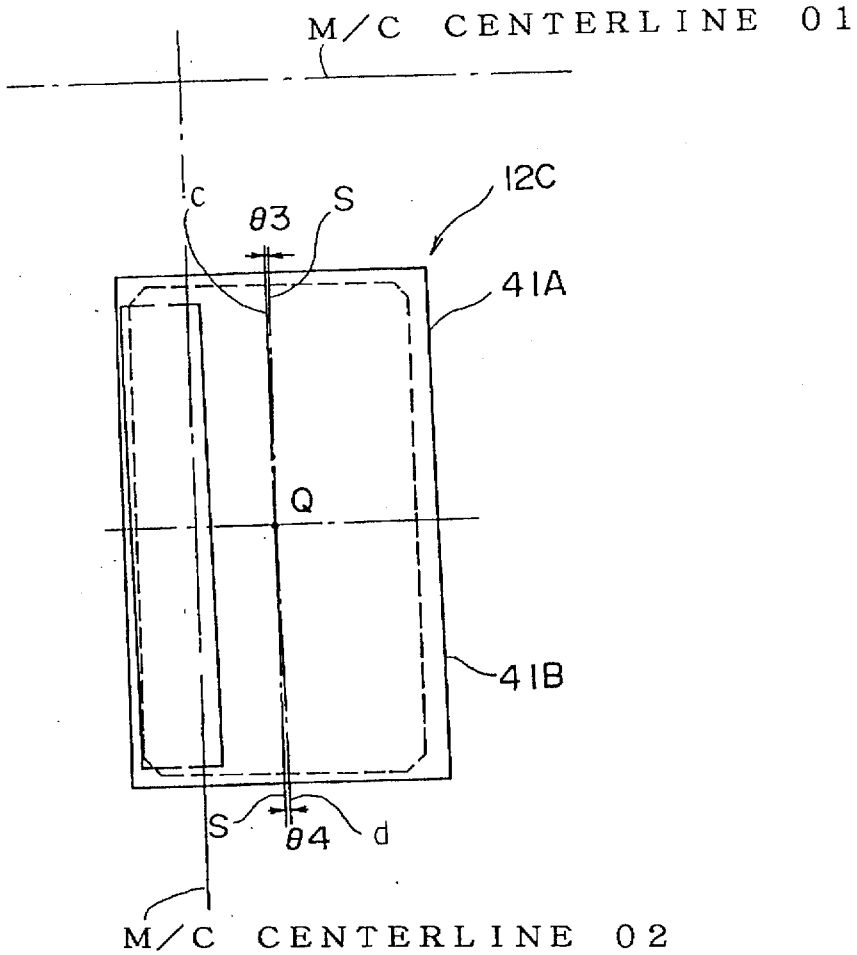
FIG. 8 is a plan view showing a shell molding insert serving as a lower die for the sleeve forming port on of the shell mold opposite to the subrunner-side sleeve forming portion of FIG. 4.

The rear-side shell molding insert 120 may have a modified shape as follows. As shown in FIG. 8, the axis "c" of a half portion 41A of the rear-side shell molding insert 12C located on the side of the lateral M/C centerline 01 with respect to a center point Q is inclined inwardly (to the left in FIG. 8) from a reference line S by a predetermined angle θ3, the reference line S being in parallel with a longitudinal M/C center line 02. The axis "d" of a half portion 41B of the rear-side shell molding insert 12C located on the side opposite to the lateral M/O centerline 01 with respect to the center point Q is inclined outwardly (to the right in FIG. 8) from the reference line S by a predetermined angle θ4.

The group 12 of four shell molding inserts is mounted in the group 7 of four insert receiving recesses provided in the lower die heating block unit 5. That is, the front-side shell molding insert 12A is fitted into the front-side insert receiving recess 8 of the group 7 of four insert receiving recesses and then fixed using bolts. Likewise, the intermediate shell molding inserts 12B are fitted into the intermediate insert receiving recesses 8 of the group 7. The rear-side shell molding insert 12C is also fitted into the rear-side insert receiving recess 8 of the group 7.

Adjacent shell molding inserts 12A, 12B, and 12C contact each other at the mating surfaces 15. The spiny insert receiving recess 16 is formed at each undercut portion R which is formed by adjacent curved surfaces of the adjacent shell molding inserts 12A, 12B, and 12C. The sand release bores 18 extending from the spiny insert receiving recesses communicate with the sand release bores 9 provided in the lower die heating block unit 5.

The rod insertion bore portions 17 in the front-side shell molding insert 12A and the front-side rod insertion bore portions 17 in each of two intermediate shell molding inserts 12B communicate with front-side three pin insertion bores 10 provided in the lower die heating unit 5. Likewise, the rod insertion bore portions 17 in the rear-side shell molding insert 12C and the rear-side rod insertion bore portions 17 in each of two intermediate shell molding inserts 12B communicate with rear-side three pin insertion bores 10 provided in the lower die heating unit 5.

Spacer blocks 19 are disposed between two rows of groups 12 of shell molding inserts, i.e. between the opposed end surfaces of the opposed shell molding inserts 12A, of the opposed shell molding inserts 12B, and of the opposed shell molding inserts 12C. The spacer blocks are fixed on the lower die heating block unit 5 using bolts. The shell molding inserts 12A, 12B, and 12C in a left-hand group 12 as viewed from the worker position P are fixed at their left-hand ends using left-hand end holding members 20. Likewise, the shell molding inserts 12A, 12B, and 12C in a right-hand group 12 as viewed from the worker position P are fixed at their right-hand ends using right-hand end holding members 21. The left- and right-hand end holding members 20 and 21 are fixed on the lower die heating block unit 5 using bolts.

The spiny inserts 22 are inserted into the spiny insert receiving recesses 16 such that they are allowed to project from the recesses and retract thereinto. As shown in FIGS. 22 to 25, each spiny insert 22 has an insert body 23. The curved surface **23*a* of the insert body 23 has the same curvature as the curved surfaces of the front-side, intermediate, and rear-side shell molding inserts 12A, 12B, and 12C. Many protrusions 24 are formed on the curved surface 23*a*. The insert body 23 is provided with two rods 25, and end of each rod 25 is formed into a threaded portion 25*a***.

Figure 39:
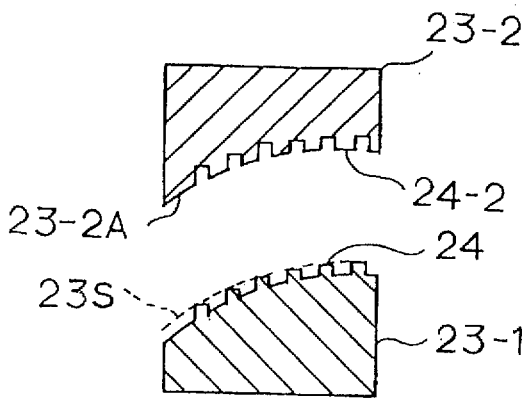
FIG. 39 is a view illustrating machining of the spiny insert by electric spark machining.
Figure 40:
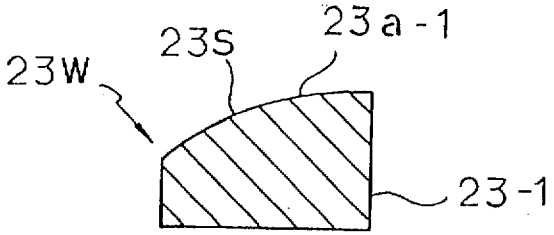
FIG. 40 is a cross-sectional view showing the shape of the spiny insert before being machined, wherein regarding FIGS. 4 to 8, shell molds formed on the MP side are symmetric with respect to the M/C centerline 01.

Each of the spiny inserts 22 described above is manufactured by machining an insert material block 23-1 shown in FIG. 40 by an electric spark machining process. The insert material block 23-1 has a curved surface **23*a*-1. The insert material block 23-1 is subjected to electric spark machining as a workpiece 23W, using an electrode 23-2 shown in FIG. 39. The surface 23-2A of the electrode 23-2 is curved concavely so as to correspond to the surface 23S (convexly curved surface 23*a*-1) of the workpiece 23W to be subjected to electric spark machining. Many recesses and protrusions 24-2 are formed in the curved surface 23-2A**.

The machining electrode 23-2 and the workpiece 23W are positioned such that the surface 23-2A of the electrode faces the surface 23S to be machined of the workpiece (the spacing between the surface 23-2A and the surface 23S is very narrow, and an insulating liquid such as KEROSINI, water or the like is present therebetween). An impulse voltage of 60–300 V is applied between the machining electrode 23-2 and the workpiece 23W to perform intermittent spark discharge, causing an abnormal consumption phenomenon. The abnormal consumption phenomenon is utilized for reversely copying the recesses and protrusions 24-2 of the machining electrode 23-2 onto the surface 23S of the workpiece 23W, thereby forming many protrusions 24 on the workpiece 23W.

The thus manufactured spiny insert 22 is retractably inserted into the spiny insertion recess 16 while the rods 25 thereof are inserted into the rod insertion bore portions 17.

As shown in FIG. 9, right and left (as viewed from the worker position P) slide block positioning arms 26 are fixed to the die base 4 at the front side thereof, and right and left slide block positioning arms 27 are fixed to the die base 4 at the rear side thereof. As shown in FIG. 11, a cylinder holding member 28 is fixed to the die base 4 at the intermediate portion of the front side thereof, and a cylinder holding member 29 is fixed to the die base 4 at the intermediate portion of the rear side thereof. Each of the front-side right and left slide block positioning arms 26 has a pair of support portions 30, in which pin bores 31 are formed. The front-side right and left slide block positioning arms 26 hold in place the front-side slide block 32A.

Figure 13:
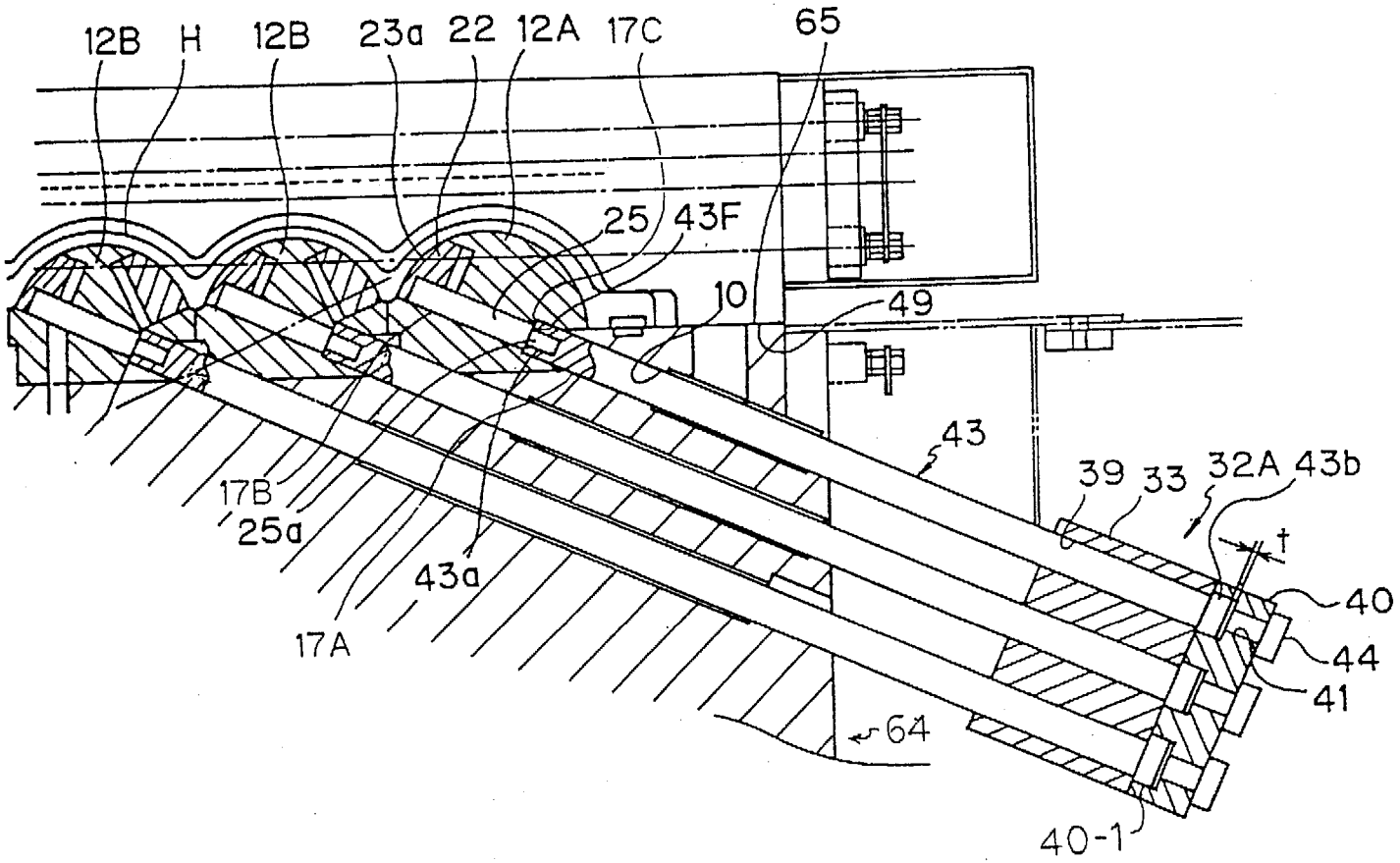
FIG. 13 is an enlarged view showing portion D of FIG. 11.
Figure 26A:
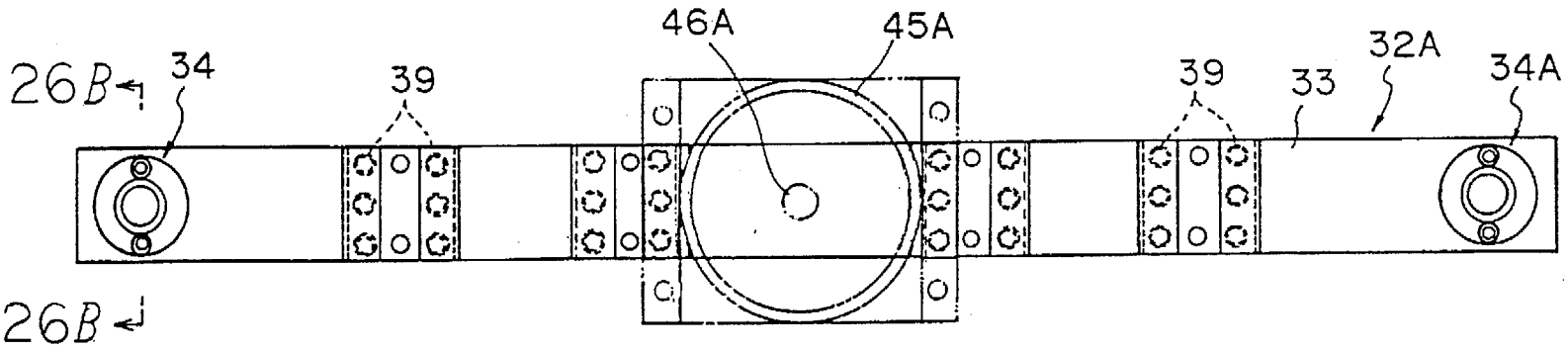
FIG. 26A is a front view showing a slide block mechanism.
Figure 26B:
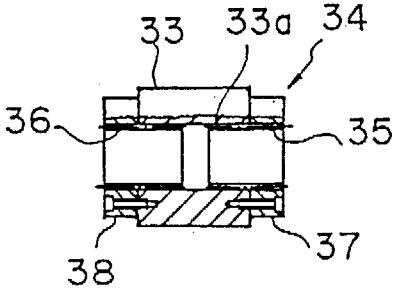
FIG. 26B is a partial cross-sectional view along line 26B—26B of FIG. 26A.
Figure 27A:
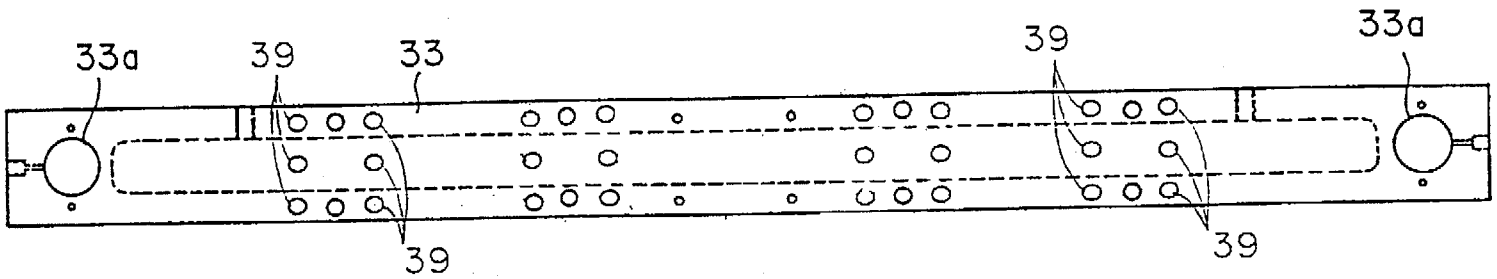
FIG. 27A is a front view showing a slide block.
Figure 27B:
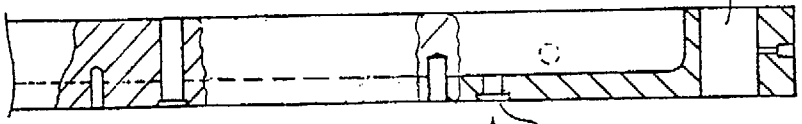
FIG. 27B is a cross-sectional view of the slide block with part thereof omitted.
Figure 27C:
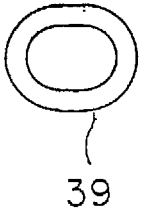
FIG. 27C is a view in the direction of arrow 27C of FIG. 27B.
Figure 28:
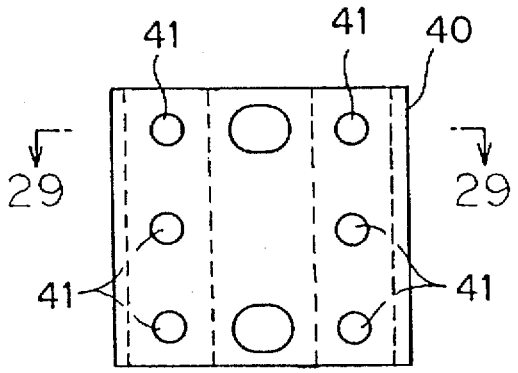
FIG. 28 is a plan view of a pin receiving member.
Figure 29:
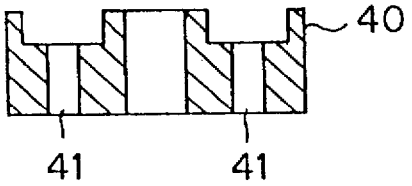
FIG. 29 is a cross-sectional view along line 29—29 of FIG. 28.

As shown in FIGS. 26A and 27A, the slide block 32A has a long block member 33 having a rectangular cross-section. A pin sliding mechanism 34 is provided at each of both end portions of the block member 33. The pin sliding mechanism 34 has a structure in which guide bushings 35 and 36 are inserted into a bore 33*a* formed in the block member 33 and that the guide bushings 35 and 36 are held in place by the bushing holders 37 and 38. Two groups of pin insertion bores 39, each having three bores, are formed in parallel with each other in the block member 33 on the right and left sides with respect to the central portion of the block member 33. As shown in FIG. 13, a pin receiving member 40 is fixed to the block member 33 behind the pin insertion bores 39. Threaded bores 41 are formed in the pin receiving member 40 such that they face the end portions of the pin insertion bores 39.

The slide block 32A having the above-described structure is held by the front-side right and left slide block positioning arms 26 while the guide bushings 35 and 36 of the pin sliding mechanism 34 are slidably fitted to slide pins 42 which are supported by a pair of support portions 30.

As shown in FIG. 13, each of withdrawal pins 43 has a threaded bore 43*a* at the tip end thereof and a polygonal flange 43*b* at the base end thereof. The withdrawal pins 43 are inserted into the pin insertion bores 39 of the slide block 32 and into the pin insertion bores 10 of the lower die heating block unit 5. The threaded portions 25*a* of the rods 25 of each spiny insert 22 are screwed into the threaded bores of the withdrawal pins 43, whereby the withdrawal pins are engaged with the spiny insert 22. In order to prevent the rotation between the rods 25 and the withdrawal pins 43, polygonal washers are inserted into the pin receiving member 40.

Adjusting bolts 44 are screwed into the threaded bores 41 of the pin receiving members 40, and a spacing "t" is formed between the end surfaces of the adjusting bolts 44 and the end surfaces of the flanges 43*b* of the withdrawal pins 43 so as to absorb variations in length of the withdrawal pins 43 caused by thermal expansion. An actuator cylinder 45A is mounted to the front-side cylinder holding member 28, and the piston rod (not shown) of the actuator cylinder 45A is fixed to the slide block 32A at the central portion thereof. The actuator cylinder 45A, the slide block 32A, and the withdrawal pins 43 constitute front-side spiny insert actuating means.

The rear-side slide block 32B has the same structure as the front-side slide block 32A as described below. As in the front-side slide block 32A, the rear-side slide block 32B is held in place by right and left slide block positioning arms 27. Withdrawal pins 43 are inserted into pin insertion bores 39 of the slide block 32B and into the pin insertion bores 10. The threaded portions 25*a* of the rods 25 of the spiny insert 22 are screwed into the threaded bores 43 of the withdrawal pins 43, whereby the withdrawal pins 43 are engaged with the spiny insert 22.

An actuator cylinder 45B is mounted to the rear-side cylinder holding member 28, and the piston rod (not shown) of the actuator cylinder 45B is fixed to the slide block 32B at the central portion thereof. The actuator cylinder 45B, the slide block 32B, and the withdrawal pins 43 constitute rear-side spiny insert actuating means.

As shown in FIG. 10, a plurality of eject pin bores 46 are formed in the apparatus base 3, the die base 4, and the lower die heating block unit 5. Eject pins 47 are inserted into the eject pin bores 46. The eject pins 47 are linked together and moved vertically by an ejecting lift mechanism (not shown), thus forming eject means.

Figure 30:
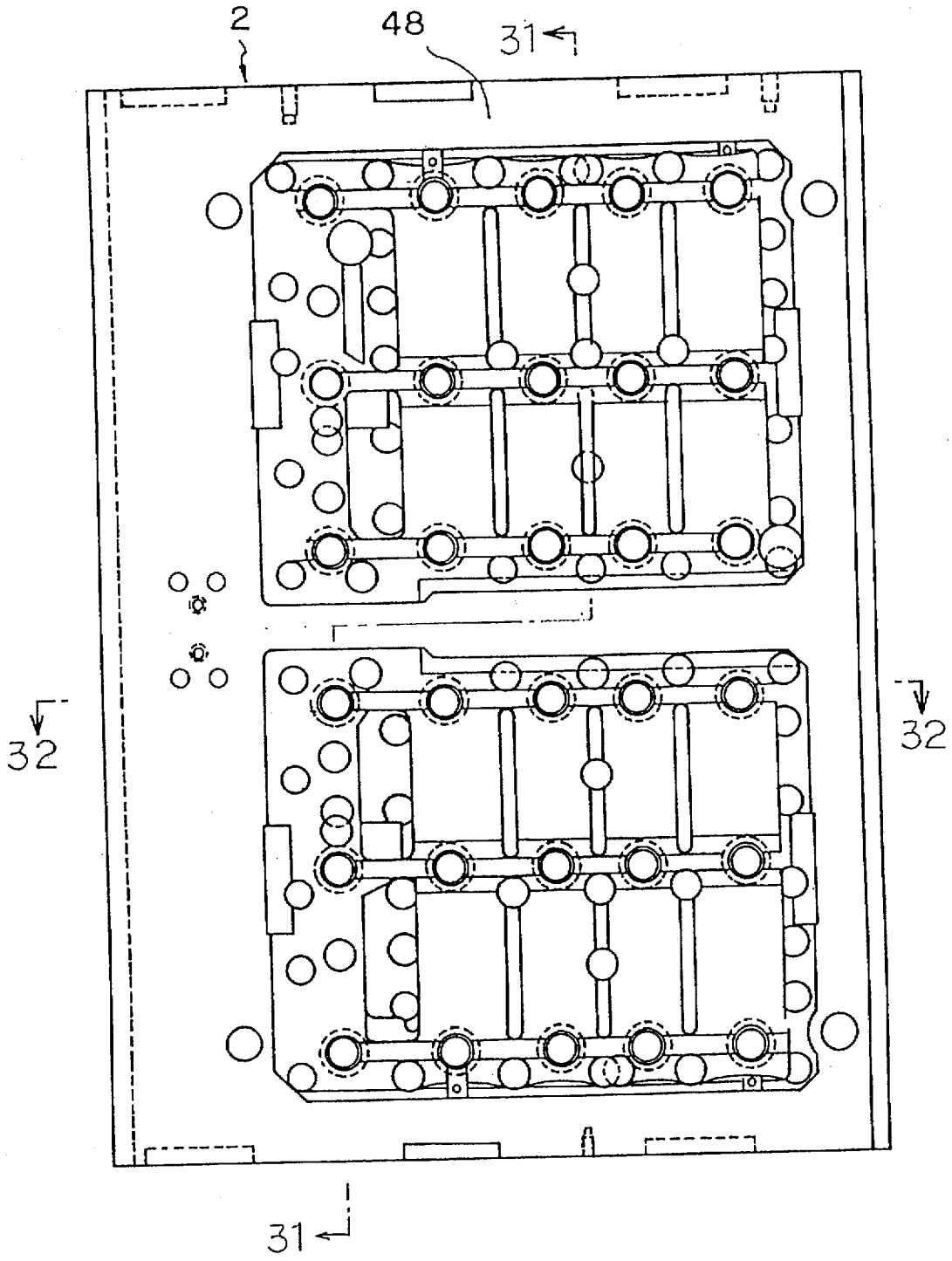
FIG. 30 is a plan view showing an upper die.
Figure 31:
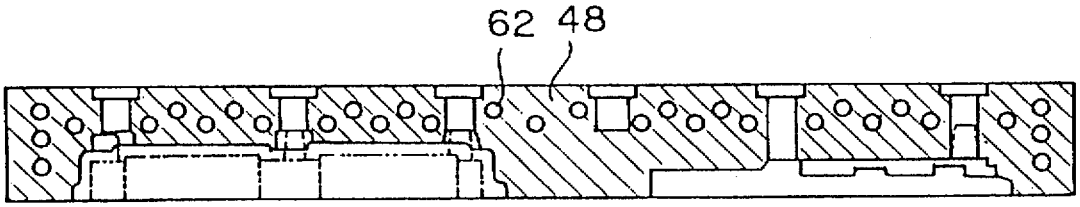
FIG. 31 is a cross-sectional view along line 31—31 of FIG. 30.
Figure 32:
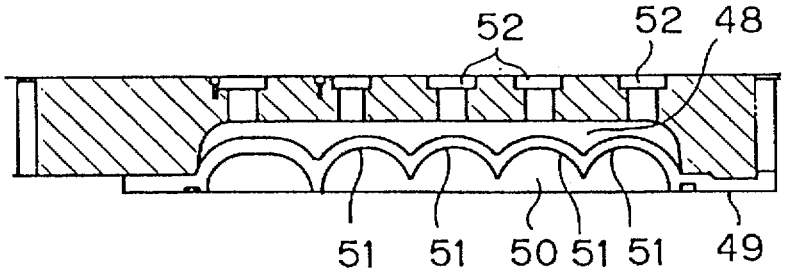
FIG. 32 is a cross-sectional view along line 32—32 of FIG. 30.

The upper die 2 has an upper die unit 48, in which, as shown in FIGS. 30 to 32, a die parting face 49 of a cavity 50 is formed. The cavity is formed of a plurality of continuous recesses 51 corresponding to the shell molding inserts 12A, 12B, and 12C of the lower die 1. The upper die unit 48 is provided with gates 52, each communicating with each of the recesses 51. Many heater insertion bores 62 are formed through the upper die unit 48 in the front-rear direction, and heaters 63 are inserted into the bores. The upper die 2 is moved vertically by a lift mechanism (not shown).

How a shell mold is molded by the shell molding apparatus having the above-described structure and a casting method using the molded shell mold will now be described.

The actuator cylinders 45A and 45B of the lower die 2 are expanded to move the slide blocks 32A and 32B to thereby moving the withdrawal pins 43 until the end surfaces 43F of the withdrawal pins 43 abut against the stepped stop ends 17C of the rod insertion bore portions 17. As a result, the spiny inserts 22 engaged with the withdrawal pins 43 advance, so that the curved surfaces 23*a* of the spiny inserts 22 coincide with the surfaces of the front-side, intermediate, and rear-side shell molding inserts 12A, 12B, and 120. Thus, many protrusions 24 on the curved surfaces 23*a* project.

Next, the above-mentioned lift mechanism operates to lower the upper die 2 until the parting face 49 of the upper die unit 48 and the parting face 65 of the lower die unit 64 mate each other. As a result, the shell molding inserts 12A, 12B, and 12C are inserted into corresponding recesses 51 of the cavity 50, whereby a space H having the shape of a sand mold to be molded is formed between the shell molding inserts and the recesses.

Then, shell sand (mixture of silica sand and thermosetting polymeric material) is charged into the space H through the plurality of gates 52 provided in the upper die unit 48.

Next, the heaters 61 and 63 provided in the upper and lower dies 1 and 2 are energized to heat the upper and lower die units 48 and 64 and shell molding inserts 12A, 12B, and 12C to a temperature of about 350° C. As a result, the shell sand hardens to form the shell mold 70.

Then, the heaters 61 and 63 are de-energized. The upper die 2 is raised by the lift mechanism to part the upper die 2 from the lower die 1. In this state, the shell mold 70 is attached to the shell molding inserts 12A, 12B, and 12C of the lower die 1.

Next, the actuator cylinders 45A and 45B of the lower die 2 are contracted to retreat the slide blocks 32A and 32B to thereby retract the spiny inserts 22 via the withdrawal pins 43. This retracts the curved surfaces 23*a* of the spiny inserts 22 from the surfaces of the front-side, intermediate, and rear-side shell molding inserts 12A, 12B, and 12C, thereby parting many protrusions 24 provided on the curved surfaces 23*a* from the shell mold 70. When the protrusions 24 are about 2 mm long, the amount of retraction of the spiny inserts 22 is about 5 mm.

Then, the ejector lift mechanism operates to raise the eject pins 47 to push up the shell mold 70 to part it from the lower die 1. The obtained shell mold 70 is half of a required shell mold and is provided at the undercut portions on the inner surface thereof, with many depressions which are formed by reversely copying many protrusions 24 of the spiny inserts 22.

Figure 35:
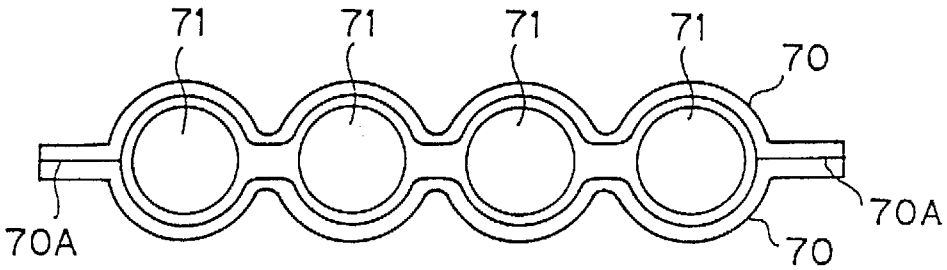
FIG. 35 is a plan view showing a shell mold composed of halved shell molds and bore forming inserts placed therebetween.

At the subsequent step, as shown in FIG. 35, two halved shell molds 70 are engaged each other by bonding them at mating surfaces 70A while four bore forming cores 71 are placed therebetween.

In the thus formed shell mold, the sleeve forming portion 74A of the quadruple-sleeve forming portion 74 adjacent to the subrunner portion 73 is previously modified in shape as shown in FIGS. 4 and 5. The axis "a'" of the upper half portion 75A located above the center point Q1 in FIG. 4 is inclined inwardly (to the right in FIG. 4) from the reference line S' by a predetermined angle θ1. The axis "b'" of the lower half portion 75B located below the center point Q1 in FIG. 4 is inclined outwardly (to the left in FIG. 4) from the reference line S' by a predetermined angle θ2.

As shown in FIG. 5, the sleeve forming portion 74A is inclined at an angle a such that the end portion of the upper half portion 75A is lower than that of the lower half portion 75B.

Figure 36:
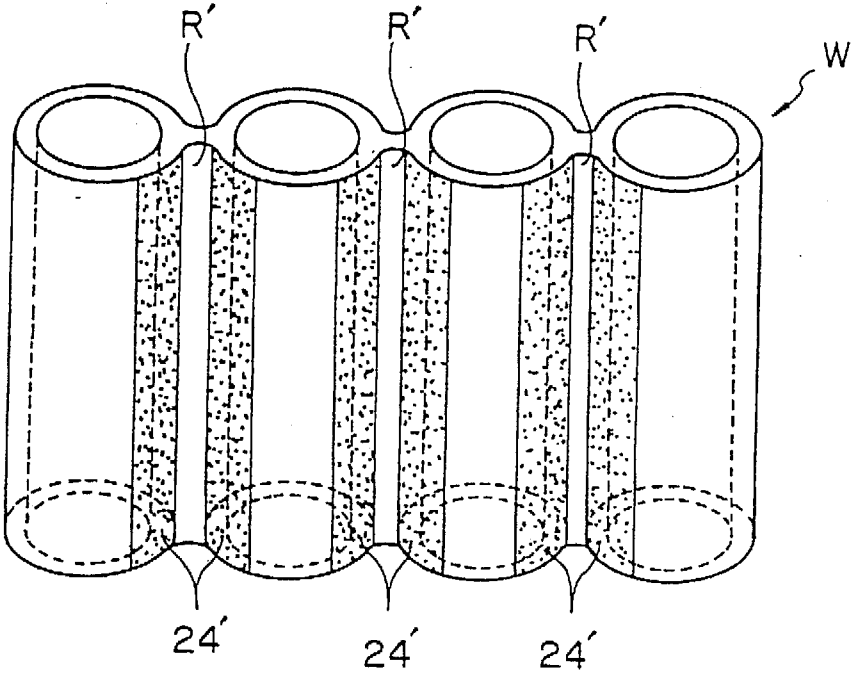
FIG. 36 is a perspective view showing a quadruple sleeve.
Figure 37:
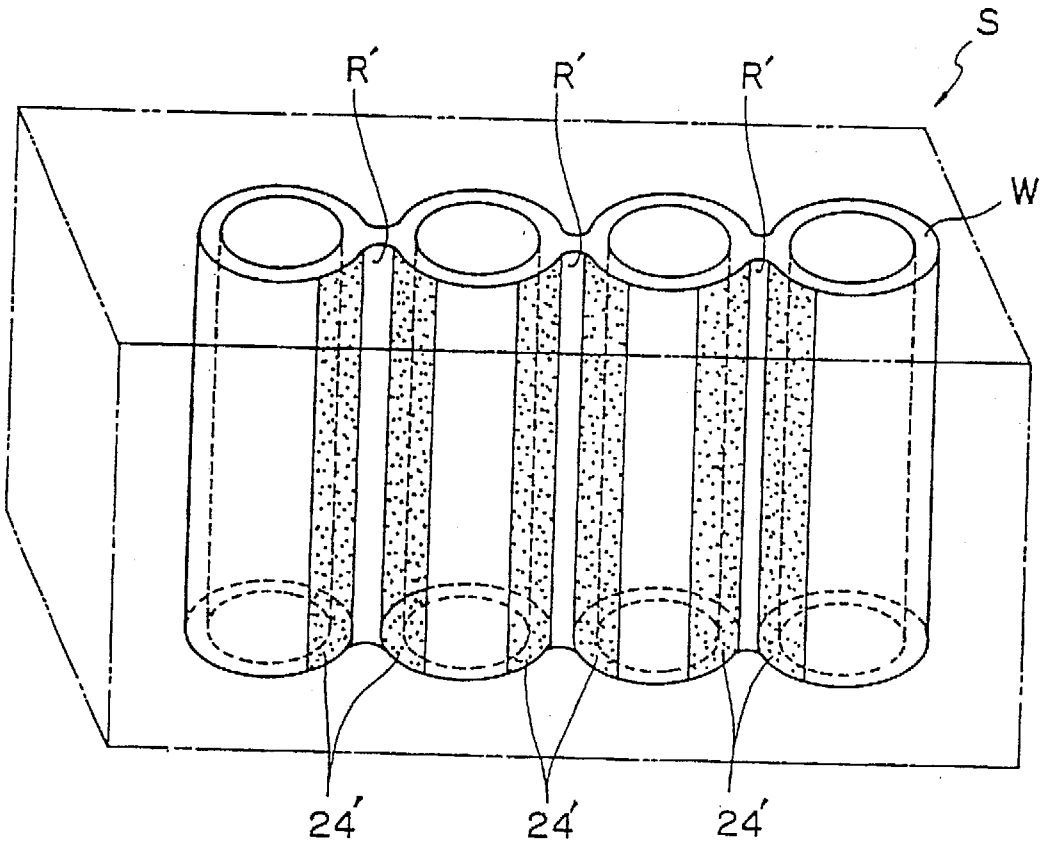
FIG. 37 is a perspective view showing a cylinder block.
Figure 38:
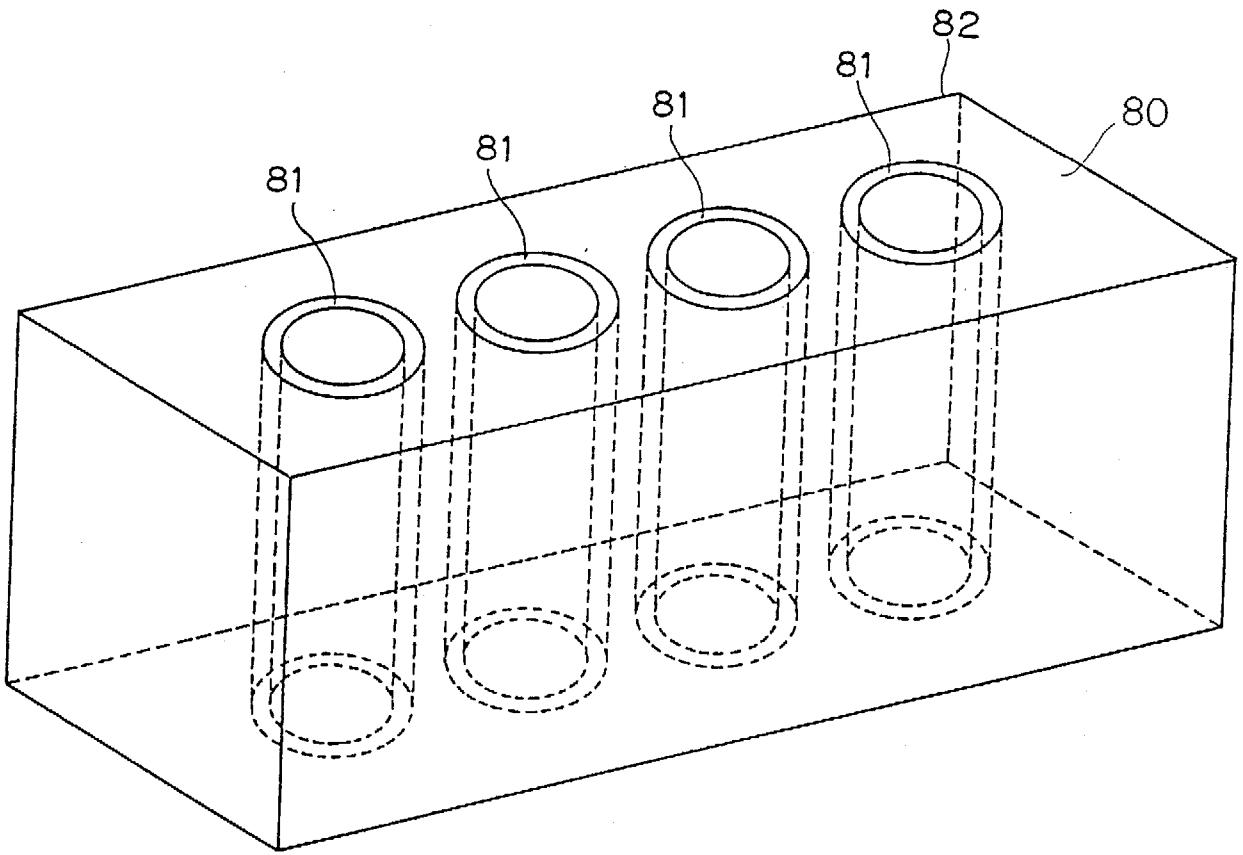
FIG. 38 is a perspective view showing a conventional cylinder block.

The shell mold is transferred to a casting site, where molten aluminum alloy is poured into the shell mold to cast a quadruple-sleeve W shown in FIG. 36. Many protrusions 24' are formed on the sleeve W at undercut portions R' thereof. In a subsequent aluminum die casting, the sleeves W are embedded in an aluminum alloy so as to manufacture a cylinder block S shown in FIG. 37.

Figure 33:
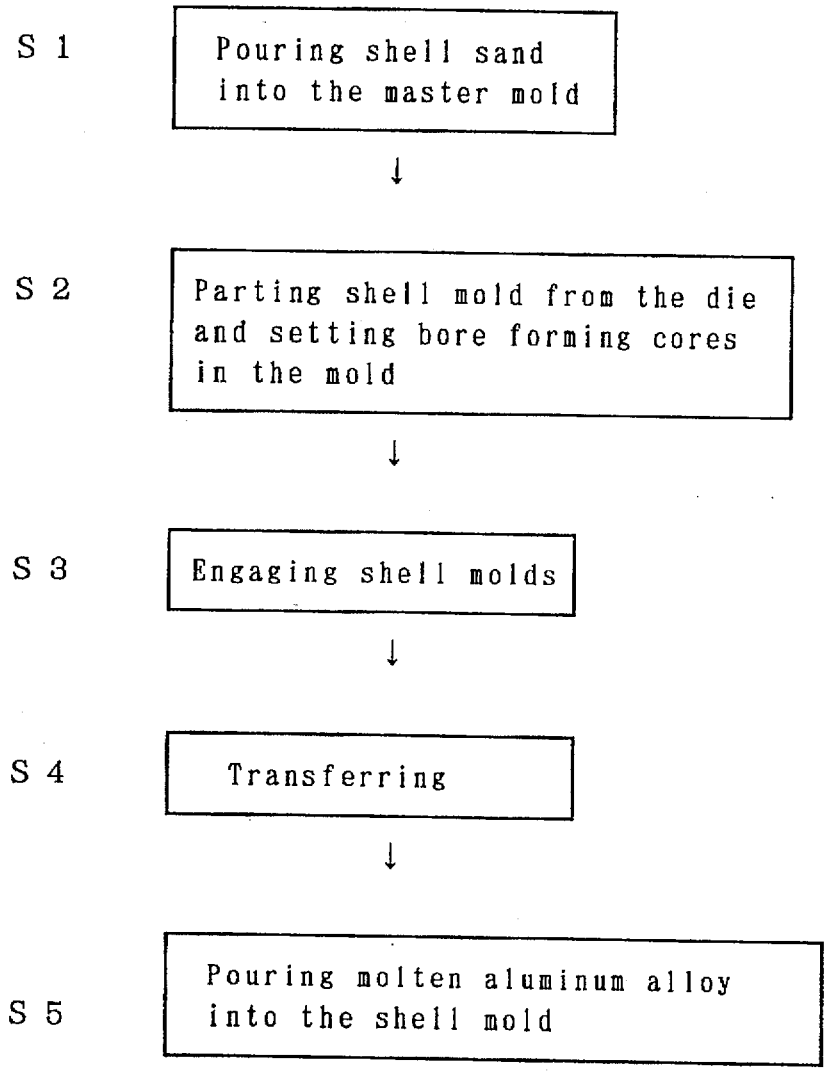
FIG. 33 is a flowchart showing a casting method using the shell mold according to the present invention.

The flow chart of FIG. 33 shows the steps of molding the above-described shell mold and forming a cast using the shell mold. At step S1 of the flow chart, many protrusions 24 of the spiny inserts 22 provided in the lower die 1 are reversely copied to the shell mold 70 at the undercut portions of the inner surface thereof by advancing the spiny inserts 22, thereby forming many depressions in the undercut portions.

At step S2, the halved shell mold 70 is parted from the lower die 1, and then four bore forming cores 71 are set in place in the halved shell mold 70. At step S3, the halved shell mold 70 and another halved shell mold 70 are engaged each other by bonding them at their mating surfaces 70A, whereby a shell mold for casting is prepared. At step S4, the shell mold is transferred to the casting site. At step S5 in the casting site, molten aluminum alloy is poured into the shell mold so as to cast the quadruple-sleeve W.

Figure 34:
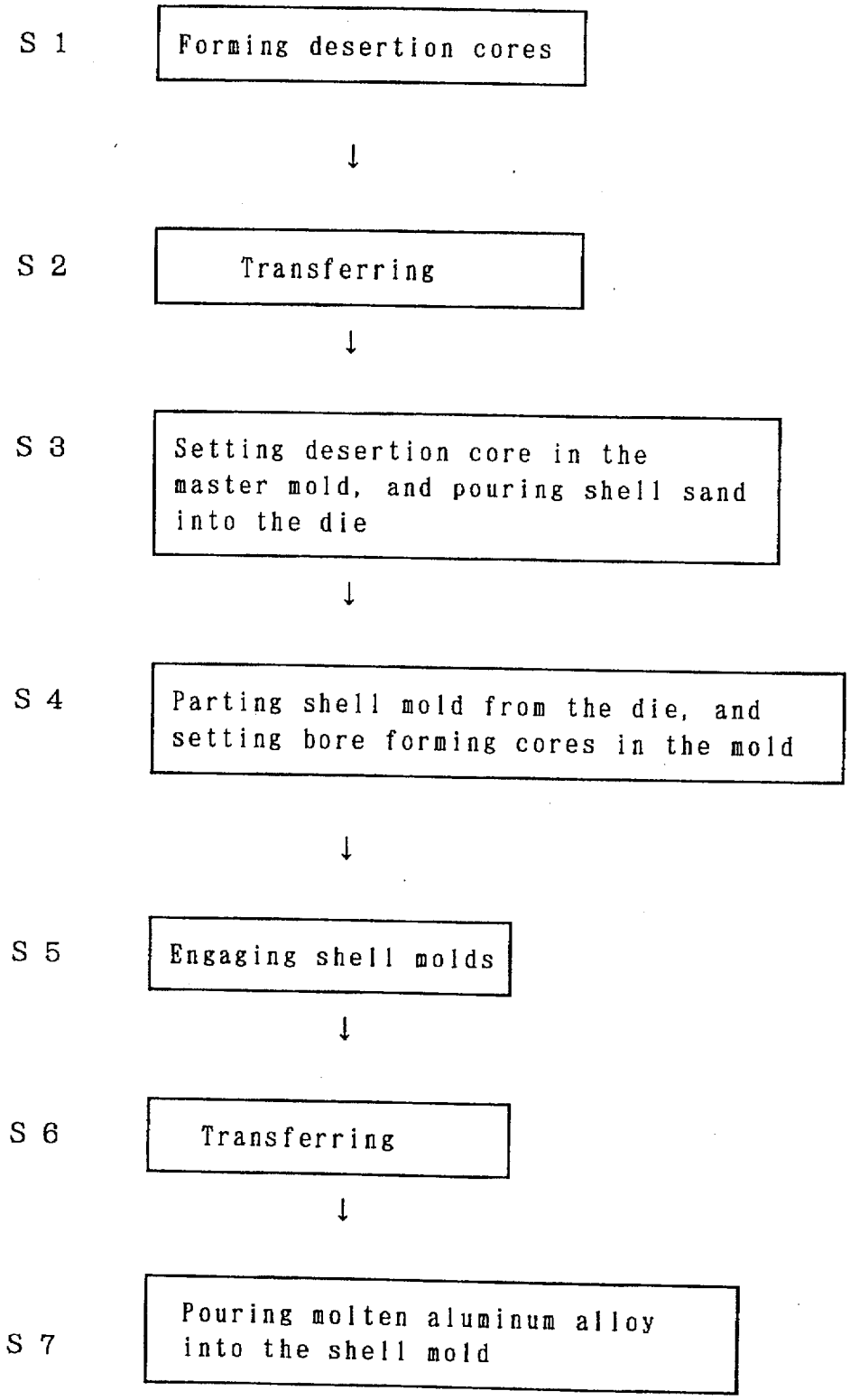
FIG. 34 is a flowchart showing a casting method using a desertion core.

The flow chart of FIG. 34 shows steps of performing casting by using a desertion core. At step S1 of the flow chart, desertion cores having many protrusions are formed. At step S2, the prepared desertion cores are transferred to the next shell molding step. At step S3, the desertion cores are set in place in a master mold, and many protrusions of the desertion core are reversely copied to a shell mold at the undercut portions of the inner surface thereof, thereby forming many depressions in the undercut portions.

At step S4, the halved shell mold is parted from a lower die, and then four bore forming cores are set in place in the halved shell mold. At step S5, the halved shell mold and another halved shell mold are engaged each other by bonding them at their mating surfaces, whereby a shell mold for casting is prepared. At step S6, the shell mold is transferred to a casting site. At step S7 in the casting shop, molten aluminum alloy is poured into the shell mold to cast a quadruple-sleeve W.

As seen from the description above, as compared to the method using the desertion core represented by the flow chart of FIG. 34, the proposed method represented by the flow chart of FIG. 33 does not require the step of forming the desertion core having many protrusions (step S1 of FIG. 34), the step of transferring the desertion core (step S2 of FIG. 34), and the step of setting in place the desertion core in the master mold (step S3 of FIG. 34).

As described above, the shell mold according to the present invention has a structure in which a plurality of sleeve forming portions are continuously provided and in which, of the sleeve forming portions, at least the subrunner-side sleeve forming portion has a modified shape at the end portion thereof such that the modified shape compensates for deformation of a cast sleeve caused by solidification and contraction of molten metal. As a result, the shell mold of the present invention can be used for mass production of double sleeves or sleeves of a higher multiple and can suppress deformation of cast sleeves caused by solidification and contraction of molten metal, thereby enabling the casting of free of deformation sleeves.

Also, the shell mold according to the present invention has a structure in which a plurality of sleeve forming portions are continuously provided and in which, of the sleeve forming portions, at least the endmost sleeve forming portion adjacent to the subrunner portion 73 has a modified shape as follows. The axis "a'" of one half portion with respect to the center point Q1 is inclined inwardly from the reference line S' by a predetermined angle θ1. The axis "b'" of the other half portion is inclined outwardly from the reference line S' by a predetermined angle θ2. As a result, the shell mold of the present invention can be used for mass production of double sleeves or sleeves of a higher multiple and can suppress deformation of cast sleeves caused by solidification and contraction of molten metal, thereby enabling the casting of deformation free sleeves.

As described above, the shell molding apparatus according to the present invention can easily manufacture, without using desertion cores, a halved shell mold in which many protrusions of spiny inserts are reversely copied to the inner surface of the halved shell mold at the undercut portions, thereby forming many depressions in the undercut portions. By engaging thus formed two halved shell molds while bore forming cores are set in place therebetween, it is possible to mass-produce double sleeves or sleeves of a higher multiple provided with many protrusions at their undercut portions.

Also, the shell molding apparatus according to the present invention has the following structure. A die set for molding a shell mold is composed of an upper die and a lower die. The lower die is composed of a plurality of shell molding inserts, each having the shape of a halved cylinder, which are inserted into recesses provided in the cavity of the upper die, thereby forming a space having the shape of a shell mold to be molded between the upper and lower dies. Further, the space has a shape corresponding the shape of the shell mold in which the subrunner-side sleeve forming portion of the space has a modified shape for compensating for deformation of cast sleeves caused by solidification and contraction of molten metal. Thus, the shell molding apparatus can mold a shell mold capable of mass-producing double sleeves or sleeves of a higher multiple while and suppressing deformation of cast sleeves caused by solidification and contraction of molten metal.

Further, the shell molding apparatus according to the present invention has the following structure. A die set for molding a shell mold is composed of an upper die and a lower die. The lower die is composed of a plurality of shell molding inserts, each having the shape of a halved cylinder. Of the shell molding inserts, an endmost shell molding insert is modified in shape as follows. The axis "a" of one half portion of an endmost shell molding insert located on the side of the lateral M/C centerline 01 with respect to the center point Q is inclined inwardly from the reference line S by a predetermined angle θ1, the reference line S being in parallel with the longitudinal M/C centerline θ2. The axis "b" of the other half portion of the endmost shell molding insert is inclined outwardly from the reference line S by a predetermined angle θ2. The shell molding inserts are inserted into recesses provided in the cavity of the upper die, thereby forming a space having the shape of a sand mold to be molded between the upper end lower dies. Thus, the proposed shell molding apparatus can mold a shell mold capable of mass-producing double sleeves or sleeves of a higher multiple and suppressing deformation of cast sleeves caused by solidification and contraction of molten metal.

The casting method using the shell mold according to the present invention does not require the step of forming desertion cores having many protrusions, the step of transferring the desertion cores, and the step of setting in place the desertion cores in a master mold as required in a conventional casting method using desertion cores.

What is claimed is:

1. A shell mold comprising a plurality of sleeve forming portions, wherein of said plurality of sleeve forming portions, at least an endmost sleeve forming portion located adjacent to a subrunner portion has a modified orientation along a longitudinal axis of said endmost sleeve forming portion, compared to the other of said plurality of sleeve forming portions, for compensating for deformation of a cast sleeve caused by solidification and contraction of molten metal.

2. A shell mold comprising a plurality of sleeve forming portions, wherein of said plurality of sleeve forming portions, at least an endmost sleeve forming portion located adjacent to a subrunner portion has a modified shape, such that a first axis of one half portion of the endmost sleeve forming portion with respect to a central point of the endmost sleeve forming portion is inclined in a first direction from a longitudinal reference line passing through the central point by a first predetermined angle and that a second axis of the other half portion of the endmost sleeve forming portion with respect to the central point of the endmost sleeve forming portion is inclined in a second direction from the longitudinal reference line by a second predetermined angle.

3. A shell molding apparatus comprising an upper die and a lower die which constitute a die set for molding a shell mold, wherein said lower die comprises a plurality of adjacent shell molding inserts, each having the shape of a halved cylinder with a curved surface, spiny insert receiving recesses which are formed in undercut portions, said undercut portions being formed by the curved surfaces of adjacent shell molding inserts, and spiny inserts retractably provided in the spiny insert receiving recesses, each spiny insert having a curved surface corresponding to the curved surface of the shell molding inserts and provided with many protrusions on the curved surface of the spiny insert.

4. A shell molding apparatus according to claim 3, wherein said upper die is formed such that a body of said upper die has a plurality of continuously formed recesses corresponding to the plurality of shell molding inserts of said lower die, thereby forming a continuous cavity between said upper and lower dies.

5. A shell molding apparatus according to claim 3, wherein a cavity having a shape of a shell mold is defined by recesses formed in a cavity of said upper die and said shell molding inserts of said lower die such that a portion of a space corresponding to a subrunner-side end portion of a sleeve forming portion has a modified orientation along a longitudinal axis of the subrunner-side end portion of the sleeve forming portion to compensate for deformation of a cast sleeve caused by solidification and contraction of molten metal.

6. A shell molding apparatus according to claim 5, wherein of said plurality of said shell molding inserts, an endmost shell molding insert has a modified shape such that a first axis of a half portion of the shell molding insert with respect to a central point of the endmost shell molding insert is inclined in a first direction from a longitudinal reference line passing through the central point by a first predetermined angle, and that a second axis of the other half portion of the shell molding insert with respect to the central point of the endmost shell molding insert is inclined in a second direction from the longitudinal reference line by a second predetermined angle, and thus formed, said shell molding inserts are inserted into the recesses formed in the cavity of said upper die, thereby forming a space in a shape of a sand mold to be molded between said shell molding inserts and the recesses to form a shell mold that compensates for deformation of a cast sleeve caused by solidification and contraction of molten metal.

7. A shell molding apparatus according to claim 3, further comprising spiny insert actuating means for projecting and retracting said spiny inserts, upper die moving means for causing said upper die to contact and part from said lower die, and ejecting means for parting a molded shell mold from said lower die.

8. A shell molding apparatus according to claim 7, wherein said spiny insert actuating means comprises a withdrawal pin connected to said spiny insert, a slide block for actuating the withdrawal pin, and an actuator cylinder for actuating the slide block.

9. A shell molding apparatus according to claim 7, wherein said spiny insert actuating means has a structure in which:

a first and a second slide block positioning arm are each respectively fixed to said lower die at first and second end portions of the lower die, and a first and a second cylinder holding member are each respectively fixed on said lower die at a central portion of first and second longer sides of the lower die;

said first slide block positioning arm holds a first slide block such that said slide block can move toward said spiny inserts;

said second slide block positioning arm holds a second slide block such that said slide block can move toward said spiny inserts;

said first and second slide blocks hold end portions of a plurality of withdrawal pins connected to said spiny inserts;

a first actuator cylinder for actuating said first slide block is provided on said first cylinder holding member; and a second actuator cylinder for actuating said second slide block is provided on said second cylinder holding member.

10. A shell molding apparatus according to claim 3, wherein said protrusions of each spiny insert are formed on the curved surface of said spiny insert by electric spark machining.

11. A casting method using a shell mold, comprising the steps of:

reversely copying many protrusions of a spiny insert to an inner surface of a halved shell mold, comprising at least one semi-circles disposed adjacent to a lower die, at an undercut portion of the inner surface, said undercut portion being formed by curved surfaces of adjacent semicircles, said protrusions being formed by moving a retractable spiny insert provided in the lower die, thereby forming many depressions in the undercut portion;

parting the halved shell mold from the lower die;

disposing a plurality of bore forming cores in the halved shell mold;

engaging the halved shell mold and another halved shell mold each with other by mating the halved shell molds with each other at mating surfaces of the halved shell molds, thereby forming a shell mold for casting; and performing casting using the thus formed shell mold.

* * * * *